US008340306B2

(12) United States Patent
Faller

(10) Patent No.: US 8,340,306 B2
(45) Date of Patent: Dec. 25, 2012

(54) PARAMETRIC CODING OF SPATIAL AUDIO WITH OBJECT-BASED SIDE INFORMATION

(75) Inventor: Christof Faller, Tägerwilen (CH)

(73) Assignee: Agere Systems LLC, Allentown, PA (US)

( * ) Notice: Subject to any disclaimer, the term of this patent is extended or adjusted under 35 U.S.C. 154(b) by 1594 days.

(21) Appl. No.: 11/667,747

(22) PCT Filed: Nov. 22, 2005

(86) PCT No.: PCT/US2005/042772

§ 371 (c)(1), (2), (4) Date: May 14, 2007

(87) PCT Pub. No.: WO2006/060279

PCT Pub. Date: Jun. 8, 2006

(65) Prior Publication Data

US 2008/0130904 A1 Jun. 5, 2008

Related U.S. Application Data

(60) Provisional application No. 60/631,798, filed on Nov. 30, 2004.

(51) Int. Cl.
*H04R 5/00* (2006.01)

(52) U.S. Cl. ..... 381/23; 381/22; 704/501; 700/94

(58) Field of Classification Search ..... 381/17, 381/18, 20, 22, 23, 25, 61, 63, 94.2, 98, 309, 381/316; 704/200.1, 219, 230, 500, 501; 700/500, 501, 94

See application file for complete search history.

(56) References Cited

U.S. PATENT DOCUMENTS

| | | | | |
|---|---|---|---|---|
| 4,236,039 | A | 11/1980 | Cooper | 381/23 |
| 4,815,132 | A | 3/1989 | Minami | 381/1 |
| 4,972,484 | A | 11/1990 | Theile et al. | 704/200.1 |
| 5,371,799 | A | 12/1994 | Lowe et al. | 381/25 |
| 5,463,424 | A | 10/1995 | Dressler | 348/485 |
| 5,579,430 | A | 11/1996 | Grill et al. | 395/2.12 |

(Continued)

FOREIGN PATENT DOCUMENTS

CA 2 326 495 A1 6/2001

(Continued)

OTHER PUBLICATIONS van der Waal, R.G. et al., "Subband Coding of Stereographic Digital Audio Signals," Proc. of ICASSP '91, IEEE Computer Society, May 1991, pp. 3601-3604.

(Continued)

*Primary Examiner* — Fan Tsang
*Assistant Examiner* — Eugene Zhao
(74) *Attorney, Agent, or Firm* — Mendelsohn, Drucker & Associates, P.C.; Steve Mendelsohn

(57) ABSTRACT

A binaural cue coding scheme involving one or more object-based cue codes, wherein an object-based cue code directly represents a characteristic of an auditory scene corresponding to the audio channels, where the characteristic is independent of number and positions of loudspeakers used to create the auditory scene. Examples of object-based cue codes include the angle of an auditory event, the width of the auditory event, the degree of envelopment of the auditory scene, and the directionality of the auditory scene.

30 Claims, 9 Drawing Sheets

U.S. PATENT DOCUMENTS

| | | | | |
|---|---|---|---|---|
| 5,583,962 | A | 12/1996 | Davis et al. | 395/2.38 |
| 5,677,994 | A | 10/1997 | Miyamori et al. | 704/501 |
| 5,682,461 | A | 10/1997 | Silzle et al. | 395/2.14 |
| 5,701,346 | A | 12/1997 | Herre et al. | 381/18 |
| 5,703,999 | A | 12/1997 | Herre et al. | 395/2.12 |
| 5,706,309 | A | 1/1998 | Eberlein et al. | 375/260 |
| 5,771,295 | A | 6/1998 | Waller, Jr. | 381/18 |
| 5,812,971 | A | 9/1998 | Herre | 704/230 |
| 5,825,776 | A | 10/1998 | Moon | 370/437 |
| 5,860,060 | A | 1/1999 | Li et al. | 704/500 |
| 5,878,080 | A | 3/1999 | Ten Kate | 375/241 |
| 5,889,843 | A | 3/1999 | Singer et al. | 379/202 |
| 5,890,125 | A | 3/1999 | Davis et al. | 704/501 |
| 5,912,976 | A | 6/1999 | Klayman et al. | 381/18 |
| 5,930,733 | A | 7/1999 | Park et al. | 702/76 |
| 5,946,352 | A | 8/1999 | Rowlands et al. | 375/242 |
| 5,956,674 | A | 9/1999 | Smyth et al. | 704/200.1 |
| 6,016,473 | A | 1/2000 | Dolby | 704/500 |
| 6,021,386 | A | 2/2000 | Davis et al. | 704/229 |
| 6,021,389 | A | 2/2000 | Protopapas | 704/278 |
| 6,108,584 | A | 8/2000 | Edwards | 700/94 |
| 6,111,958 | A | 8/2000 | Maher | 381/17 |
| 6,131,084 | A | 10/2000 | Hardwick | 704/230 |
| 6,205,430 | B1 | 3/2001 | Hui | 704/500 |
| 6,236,731 | B1 | 5/2001 | Brennan et al. | 381/316 |
| 6,282,631 | B1 | 8/2001 | Arbel | 712/35 |
| 6,356,870 | B1 | 3/2002 | Hui et al. | 704/500 |
| 6,408,327 | B1 | 6/2002 | McClennon et al. | 709/204 |
| 6,424,939 | B1 | 7/2002 | Herre et al. | 704/219 |
| 6,434,191 | B1 | 8/2002 | Agrawal et al. | 375/227 |
| 6,539,357 | B1 | 3/2003 | Sinha | 704/270.1 |
| 6,611,212 | B1 | 8/2003 | Craven et al. | |
| 6,614,936 | B1 | 9/2003 | Wu et al. | 382/238 |
| 6,658,117 | B2 | 12/2003 | Hasebe | 381/61 |
| 6,763,115 | B1 | 7/2004 | Kobayashi | 381/309 |
| 6,782,366 | B1 | 8/2004 | Huang et al. | 704/500 |
| 6,823,018 | B1 | 11/2004 | Jafarkhani et al. | 375/245 |
| 6,845,163 | B1 | 1/2005 | Johnston et al. | 381/92 |
| 6,850,496 | B1 | 2/2005 | Knappe et al. | 370/260 |
| 6,885,992 | B2 | 4/2005 | Mesarovic et al. | |
| 6,934,676 | B2 | 8/2005 | Wang et al. | 704/200.1 |
| 6,940,540 | B2 | 9/2005 | Beal et al. | 348/169 |
| 6,973,184 | B1 | 12/2005 | Shaffer et al. | 379/420.01 |
| 6,987,856 | B1 | 1/2006 | Feng et al. | |
| 7,116,787 | B2 | 10/2006 | Faller | 381/17 |
| 7,181,019 | B2 | 2/2007 | Breebart et al. | |
| 7,343,291 | B2 * | 3/2008 | Thumpudi et al. | 704/500 |
| 7,382,886 | B2 | 6/2008 | Henn et al. | 381/23 |
| 7,516,066 | B2 | 4/2009 | Schuijers et al. | 704/219 |
| 7,644,003 | B2 | 1/2010 | Baumgarte et al. | |
| 7,672,838 | B1 | 3/2010 | Athineos et al. | |
| 7,941,320 | B2 | 5/2011 | Baumgarte et al. | |
| 2001/0031054 | A1 | 10/2001 | Grimani | 381/98 |
| 2001/0031055 | A1 | 10/2001 | Aarts et al. | |
| 2002/0055796 | A1 | 5/2002 | Katayama et al. | 700/94 |
| 2003/0007648 | A1 * | 1/2003 | Currell | 381/61 |
| 2003/0035553 | A1 | 2/2003 | Baumgarte et al. | 381/94.2 |
| 2003/0044034 | A1 | 3/2003 | Zeng et al. | |
| 2003/0081115 | A1 | 5/2003 | Curry et al. | 348/14.12 |
| 2003/0161479 | A1 | 8/2003 | Yang et al. | 381/22 |
| 2003/0187663 | A1 | 10/2003 | Truman et al. | 704/500 |
| 2003/0219130 | A1 * | 11/2003 | Baumgarte et al. | 381/17 |
| 2003/0236583 | A1 | 12/2003 | Baumgarte et al. | 700/94 |
| 2004/0091118 | A1 | 5/2004 | Griesinger | 381/20 |
| 2005/0053242 | A1 | 3/2005 | Henn et al. | 381/22 |
| 2005/0069143 | A1 | 3/2005 | Budnikov et al. | 381/63 |
| 2005/0157883 | A1 * | 7/2005 | Herre et al. | 381/17 |
| 2005/0226426 | A1 | 10/2005 | Oomen et al. | 381/23 |
| 2006/0009225 | A1 * | 1/2006 | Herre et al. | 455/450 |
| 2006/0206323 | A1 | 9/2006 | Breebaart | 704/230 |
| 2007/0094012 | A1 | 4/2007 | Pang et al. | |

FOREIGN PATENT DOCUMENTS

| | | | |
|---|---|---|---|
| CN | 1295778 | | 5/2001 |
| EP | 1 107 232 | A2 | 6/2001 |
| EP | 1 376 538 | A1 | 1/2004 |
| EP | 1 479 071 | B1 | 1/2006 |
| JP | 07123008 | | 5/1995 |
| JP | H10-051313 | | 2/1998 |
| JP | 2000-151413 | A | 5/2000 |
| JP | 2001-339311 | A | 12/2001 |
| JP | 2003 044096 | A | 2/2003 |
| JP | 2004193877 | A | 7/2004 |
| JP | 2004-535145 | A | 11/2004 |
| RU | 2214048 | C2 | 10/2003 |
| TW | 347623 | | 12/1998 |
| TW | 360859 | | 6/1999 |
| TW | 444511 | | 7/2001 |
| TW | 510144 | | 11/2002 |
| TW | 517223 | | 1/2003 |
| TW | 521261 | | 2/2003 |
| WO | WO 92/12607 | A1 | 7/1992 |
| WO | WO 99/52326 | A1 | 10/1999 |
| WO | WO 02/29808 | A2 | 4/2002 |
| WO | WO 03/007656 | A1 | 1/2003 |
| WO | WO 03/090207 | A1 | 10/2003 |
| WO | WO 03/090208 | A1 | 10/2003 |
| WO | WO 03/094369 | A2 | 11/2003 |
| WO | WO 2004/008806 | A1 | 1/2004 |
| WO | WO 2004/036548 | A1 | 4/2004 |
| WO | WO 2004/049309 | A1 | 6/2004 |
| WO | WO 2004/072956 | A1 | 8/2004 |
| WO | WO 2004/077884 | A1 | 9/2004 |
| WO | WO 2004/086817 | A2 | 10/2004 |
| WO | WO 2005/069274 | A1 | 7/2005 |

OTHER PUBLICATIONS

"Advances in Parametric Coding for High-Quality Audio," by E.G.P. Schuijers et al., Proc. 1st IEEE Benelux Workshop on Model Based Processing and Coding of Audio (MPCA-2002), Leuven, Belgium, Nov. 15, 2002, pp. 73-79, XP001156065.

"Binaural Cue Coding Applied to Stereo and Multi-Channel Audio Compression," by Christof Faller et al., Audio Engineering Society 112th Covention, Munich, Germany, vol. 112, No. 5574, May 10 2002, pp. 1-9.

"Efficient Representation of Spatial Audio Using Perceptual Parametrization",, by Christof Faller et al., IEEE Workshop on Applications of Signal Processing to Audio and Acoustics 2001, Oct. 21-24, 2001, New Paltz, New York, pp. W2001-01 to W2001-4.

"3D Audio and Acoustic Environment Modeling" by William G. Gardner, HeadWize Technical Paper, Jan. 2001, pp. 1-11.

"A Speech Corpus for Multitalker Communications Research", by Robert S. Bolia, et al., J. Acoust. Soc., Am., vol. 107, No. 2, Feb. 2000, pp. 1065-1066.

"The Role of Perceived Spatial Separation in the Unmasking of Speech", by Richard Freyman et al., J. Acoust. Soc., Am., vol. 106, No. 6, Dec. 1999.

"Multichannel Natural Music Recording Based on Psychoacoustic Principles", by Gunther Theile, Extended version of the paper presented at the AES 19th International Conference, May 2001, Oct. 2001, pp. 1-45.

Christof Faller, "Parametric Coding of Spatial Audio, These No. 3062," Presentee A La Faculte Informatique et Communications, Institut de Systemes de Communication, Ecole Polytechnique Federale de Lausanne, Lausanne, EPFL 2004.

"Surround Sound Past, Present, and Future" by Joseph Hull; Dolby Laboratories Inc.; 1999; 8 pages.

"Low Complexity Parametric Stereo Coding", by Erik Schuijers et al., Audio Engineering Society 116th Convention Paper 6073, May 8-11, 2004, Berlin, Germany, pp. 1-11.

"MP3 Surround: Efficient and Compatible Coding of Multi-Channel Audio", by Juergen Herre et al., Audio Engineering Society 116th Convention Paper, May 8-11, 2004, Berlin, Germany, pp. 1-14, XP-002350798.

"Parametric Coding of Spatial Audio—Thesis No. 3062," by Christof Faller, These Presentee a La Faculte Informatique et. Communications Institit De Systemes De Communication Section Des Systems De Communication Ecole Polytechnique Fédérale De Lausanne Pour L'Obtention Du Grade De Docteur Es Sciences, 2004, XP002343263, Laussane, Section 5.3, pp. 71-84.

"Binaural Cue Coding—Part I: Psychoacoustic Fundamentals and Design Principles", by Frank Baumgarte et al., IEEE Transactions on Speech and Audio Processing, vol. 11, No. 6, Nov. 2003, pp. 509-519.
"Binaural Cue Coding—Part II: Schemes and Applications", by Christof Faller et al., IEEE Transactions on Speech and Audio Processing, vol. 11, No. 6, Nov. 2003, pp. 520-531, XP-002338415.
"Advances in Parametric Coding for High-Quality Audio," by Erik Schuijers et al., Audio Engineering Society Convention Paper 5852, 114$^{th}$ Convention, Amsterdam, The Netherlands, Mar. 22-25, 2003, pp. 1-11.
"Text of ISO/IEC 14496-3:2002/PDAM 2 (Parametric coding for High Quality Audio)" by International Organisation for Standardisation ISO/IEC JTC1/SC29/WG11 Coding of Moving Pictures and Audio, MPEG2002 N5381 Awaji Island, Dec. 2002, pp. 1-69.
"Synthesized Stereo Combined with Acoustic Echo Cancellation for Desktop Conferencing", by Jacob Benesty et al., Bell Labs Technical Journal, Jul.-Sep. 1998, pp. 148-158.
"Imroving Audio Codecs by Noise Substitution," by Donald Schulz, Journal of the Audio Engineering Society, vol. 44, No. 7/8, Jul./Aug. 1996, pp. 593-598, XP000733647.
"MPEG Audio Layer II: A Generic Coding Standard for Two and Multichannel Sound for DVB, DAB and Computer Multimedia," by G. Stoll, International Broadcasting Convention, Sep. 14-18, 1995, Germany, XP006528918, pp. 136-144.
"Final text for DIS 11172-1 (rev. 2): Information Technology-Coding of Moving Pictures and Associated Audio for Digital Storage Media—Part 1," ISO/IEC JTC 1/SC 29 N 147, Apr. 20, 1992, Section 3: Audio, XP-002083108, 2 pages.
"Colorless Artificial Reverberation", by M.R. Schroeder et al., IRE Transactions on Audio, pp. 209-214, (Originally Published by: J. Audio Engrg. Soc., vol. 9, pp. 192-197, Jul. 1961).
"Responding to One of Two Simultaneous Message", by Walter Spieth et al., The Journal of the Acoustical Society of America, vol. 26, No. 3, May 1954, pp. 391-396.
Notification of Transmittal of The International Search Report and The Written Opinion of the International Searching Authority; Mailed Apr. 25, 2006 for the corresponding PCT/US2005/42772.
European Examination Report; Mailed May 4, 2011 for the corresponding European Application No. 05852198.0.
"Binaural Cue Coding: Rendering of Sources Mixed into a Mono Signal" by Christof Faller, Media Signal Processing Research, Agere Systems, Allentown, PA, USA, 2 pages.
"HILN—The MPEG-4 Parametric Audio Coding Tools" by Heiko Purnhagen and Nikolaus Meine, University of Hannover, Hannover, Germany, 4 pages.
"Parametric Audio Coding" by Bernd Edler and Heiko Purnhagen, University of Hannover, Hannover, Germany, pp. 1-4.
"Advances in Parametric Audio Coding" by Heiko Purnhagen, Proc. 1999 IEEE Workshop on Applications of Signal Processing to Audio and Acoustics, New Paltz, New York, Oct. 17-20, 1999, pp. W99-1-W99-4.
Office Action for Japanese Patent Application No. 2007-537133 dated Feb. 16, 2010 received on Mar. 10, 2010.
"Information Technology—Coding of Audio-Visual Objects—Part 1: MPEG Surround (ISO/IEC JTC 1/SC 29/WG11 N7387)," Jul. 2005, International Organizational for Standardization, Poznan, Poland, XP002370055, p. 46.
"The Reference Model Architecture for MPEG Spatial Audio Coding," by Juergen Herre et al., Audio Engineering Society Convention Paper 6447, 118$^{th}$ Convention, May 28-31, 2005, Barcelona, Spain, pp. 1-13, XP009059973.
"Coding of Spatial Audio Compatible with Different Playback Formats", by Christof Faller, Audio Engineering Society 117$^{th}$ Convention, San Francisco, CA, Oct. 28-31, 2004, pp. 1-12.
"Spatial Audio Coding: Next-Generation Efficient and Compatible Coding of Multi-Channel Audio," by J. Herre et al., Audio Engineering Society Convention Paper Presented at the 117$^{th}$ Convention, Oct. 28-31, 2004, San Francisco, CA, XP-002343375, pp. 1-13.
"From Joint Stereo to Spatial Audio Coding—Recent Progress and Standardization," by Jurgen Herre, Proc. of the 7$^{th}$ Int. Conference on Digital Audio Effects (DAFx' 04), Oct. 5-8, 2004, Naples, Italy, XP002367849.
"Parametric Coding of Spatial Audio," by Christof Faller, Proc. of the 7$^{th}$ Int. Conference on Digital Audio Effects (DAFx' 04), Oct. 5-8, 2004, Naples, Itlay, XP002367850.
Examination Office Letter; Mailed Sep. 5, 2011 for corresponding Japanese Application No. 2007-544408.
Notice of Preliminary Rejection; Mailed Feb. 28, 2012 for corresponding Korean Application No. 10-2007-7015056.

* cited by examiner

α≈18°
w=0.3
e=0

α≈18°
w=0.1
e=1.0

α≈18°
w=0
e=0.5

PARAMETRIC CODING OF SPATIAL AUDIO WITH OBJECT-BASED SIDE INFORMATION

CROSS-REFERENCE TO RELATED APPLICATIONS

This application claims the benefit of the filing date of U.S. provisional application No. 60/631,798, filed on Nov. 30, 2004, the teachings of which are incorporated herein by reference.

The subject matter of this application is related to the subject matter of the following U.S. applications, the teachings of all of which are incorporated herein by reference:

U.S. application Ser. No. 09/848,877, filed on May 4, 2001;

U.S. application Ser. No. 10/045,458, filed on Nov. 7, 2001, which itself claimed the benefit of the filing date of U.S. provisional application No. 60/311,565, filed on Aug. 10, 2001;

U.S. application Ser. No. 10/155,437, filed on May 24, 2002;

U.S. application Ser. No. 10/246,570, filed on Sep. 18, 2002;

U.S. application Ser. No. 10/815,591, filed on Apr. 1, 2004;

U.S. application Ser. No. 10/936,464, filed on Sep. 8, 2004;

U.S. application Ser. No. 10/762,100, filed on Jan. 20, 2004;

U.S. application Ser. No. 11/006,492, filed on Dec. 7, 2004;

U.S. application Ser. No. 11/006,482, filed on Dec. 7, 2004;

U.S. application Ser. No. 11/032,689, filed on Jan. 10, 2005; and

U.S. application Ser. No. 11/058,747, filed on Feb. 15, 2005, which itself claimed the benefit of the filing date of U.S. provisional application No. 60/631,917, filed on Nov. 30, 2004.

The subject matter of this application is also related to subject matter described in the following papers, the teachings of all of which are incorporated herein by reference:

F. Baumgarte and C. Faller, "Binaural Cue Coding—Part I: Psychoacoustic fundamentals and design principles," *IEEE Trans. on Speech and Audio Proc.*, vol. 11, no. 6, November 2003;

C. Faller and F. Baumgarte, "Binaural Cue Coding—Part II: Schemes and applications," *IEEE Trans. on Speech and Audio Proc.*, vol. 11, no. 6, November 2003; and C. Faller, "Coding of spatial audio compatible with different playback formats," *Preprint* 117$^{th}$ *Conv. Aud. Eng. Soc.*, October 2004.

BACKGROUND OF THE INVENTION

1. Field of the Invention

The present invention relates to the encoding of audio signals and the subsequent synthesis of auditory scenes from the encoded audio data.

2. Description of the Related Art

When a person hears an audio signal (i.e., sounds) generated by a particular audio source, the audio signal will typically arrive at the person's left and right ears at two different times and with two different audio (e.g., decibel) levels, where those different times and levels are functions of the differences in the paths through which the audio signal travels to reach the left and right ears, respectively. The person's brain interprets these differences in time and level to give the person the perception that the received audio signal is being generated by an audio source located at a particular position (e.g., direction and distance) relative to the person. An auditory scene is the net effect of a person simultaneously hearing audio signals generated by one or more different audio sources located at one or more different positions relative to the person.

The existence of this processing by the brain can be used to synthesize auditory scenes, where audio signals from one or more different audio sources are purposefully modified to generate left and right audio signals that give the perception that the different audio sources are located at different positions relative to the listener.

FIG. 1 shows a high-level block diagram of conventional binaural signal synthesizer 100, which converts a single audio source signal (e.g., a mono signal) into the left and right audio signals of a binaural signal, where a binaural signal is defined to be the two signals received at the eardrums of a listener. In addition to the audio source signal, synthesizer 100 receives a set of spatial cues corresponding to the desired position of the audio source relative to the listener. In typical implementations, the set of spatial cues comprises an inter-channel level difference (ICLD) value (which identifies the difference in audio level between the left and right audio signals as received at the left and right ears, respectively) and an inter-channel time difference (ICTD) value (which identifies the difference in time of arrival between the left and right audio signals as received at the left and right ears, respectively). In addition or as an alternative, some synthesis techniques involve the modeling of a direction-dependent transfer function for sound from the signal source to the eardrums, also referred to as the head-related transfer function (HRTF). See, e.g., J. Blauert, *The Psychophysics of Human Sound Localization*, MIT Press, 1983, the teachings of which are incorporated herein by reference.

Using binaural signal synthesizer 100 of FIG. 1, the mono audio signal generated by a single sound source can be processed such that, when listened to over headphones, the sound source is spatially placed by applying an appropriate set of spatial cues (e.g., ICLD, ICTD, and/or HRTF) to generate the audio signal for each ear. See, e.g., D. R. Begault, 3-*D Sound for Virtual Reality and Multimedia*, Academic Press, Cambridge, Mass., 1994.

Binaural signal synthesizer 100 of FIG. 1 generates the simplest type of auditory scenes: those having a single audio source positioned relative to the listener. More complex auditory scenes comprising two or more audio sources located at different positions relative to the listener can be generated using an auditory scene synthesizer that is essentially implemented using multiple instances of binaural signal synthesizer, where each binaural signal synthesizer instance generates the binaural signal corresponding to a different audio source. Since each different audio source has a different location relative to the listener, a different set of spatial cues is used to generate the binaural audio signal for each different audio source.

SUMMARY OF THE INVENTION

According to one embodiment, the present invention is a method, apparatus, and machine-readable medium for encoding audio channels. One or more cue codes are generated for two or more audio channels, wherein at least one cue code is an object-based cue code that directly represents a characteristic of an auditory scene corresponding to the audio channels, where the characteristic is independent of number and positions of loudspeakers used to create the auditory scene, and the one or more cue codes are transmitted.

According to another embodiment, the present invention is an apparatus for encoding C input audio channels to generate E transmitted audio channel(s). The apparatus comprises a code estimator and a downmixer. The code estimator generates one or more cue codes for two or more audio channels, wherein at least one cue code is an object-based cue code that directly represents a characteristic of an auditory scene corresponding to the audio channels, where the characteristic is independent of number and positions of loudspeakers used to create the auditory scene. The downmixer downmixes the C input channels to generate the E transmitted channel(s), where C>E≧1, wherein the apparatus transmits information about the cue codes to enable a decoder to perform synthesis processing during decoding of the E transmitted channel(s).

According to yet another embodiment, the present invention is a bitstream generated by encoding audio channels. One or more cue codes are generated for two or more audio channels, wherein at least one cue code is an object-based cue code that directly represents a characteristic of an auditory scene corresponding to the audio channels, where the characteristic is independent of number and positions of loudspeakers used to create the auditory scene. The one or more cue codes and E transmitted audio channel(s) corresponding to the two or more audio channels, where E≧1, are encoded into the encoded audio bitstream.

According to another embodiment, the present invention is a method, apparatus, and machine-readable medium for decoding E transmitted audio channel(s) to generate C playback audio channels, where C>E≧1. Cue codes corresponding to the E transmitted channel(s) are received, wherein at least one cue code is an object-based cue code that directly represents a characteristic of an auditory scene corresponding to the audio channels, where the characteristic is independent of number and positions of loudspeakers used to create the auditory scene. One or more of the E transmitted channel(s) are upmixed to generate one or more upmixed channels. One or more of the C playback channels are synthesized by applying the cue codes to the one or more upmixed channels.

BRIEF DESCRIPTION OF THE DRAWINGS

Other aspects, features, and advantages of the present invention will become more fully apparent from the following detailed description, the appended claims, and the accompanying drawings in which like reference numerals identify similar or identical elements.

FIG. 10(*b*) illustrates a listener perceiving a single, more diffuse auditory event (represented by the shaded oval);

FIG. 11(*b*) illustrates a listener being enveloped in a sound field, while perceiving an auditory event of a certain width at a certain angle;

DETAILED DESCRIPTION

Figure 1:
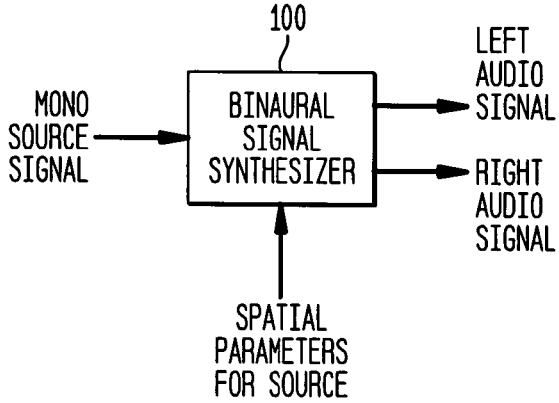
FIG. 1 (PRIOR ART)
FIG. 1 shows a high-level block diagram of conventional binaural signal synthesizer.

In binaural cue coding (BCC), an encoder encodes C input audio channels to generate E transmitted audio channels, where C>E≧1. In particular, two or more of the C input channels are provided in a frequency domain, and one or more cue codes are generated for each of one or more different frequency bands in the two or more input channels in the frequency domain. In addition, the C input channels are downmixed to generate the E transmitted channels. In some downmixing implementations, at least one of the E transmitted channels is based on two or more of the C input channels, and at least one of the E transmitted channels is based on only a single one of the C input channels.

In one embodiment, a BCC coder has two or more filter banks, a code estimator, and a downmixer. The two or more filter banks convert two or more of the C input channels from a time domain into a frequency domain. The code estimator generates one or more cue codes for each of one or more different frequency bands in the two or more converted input channels. The downmixer downmixes the C input channels to generate the E transmitted channels, where C>E≧1.

In BCC decoding, E transmitted audio channels are decoded to generate C playback (i.e., synthesized) audio channels. In particular, for each of one or more different frequency bands, one or more of the E transmitted channels are upmixed in a frequency domain to generate two or more of the C playback channels in the frequency domain, where C>E≧1. One or more cue codes are applied to each of the one or more different frequency bands in the two or more playback channels in the frequency domain to generate two or more modified channels, and the two or more modified channels are converted from the frequency domain into a time domain. In some upmixing implementations, at least one of the C playback channels is based on at least one of the E transmitted channels and at least one cue code, and at least one of the C playback channels is based on only a single one of the E transmitted channels and independent of any cue codes.

In one embodiment, a BCC decoder has an upmixer, a synthesizer, and one or more inverse filter banks. For each of one or more different frequency bands, the upmixer upmixes one or more of the E transmitted channels in a frequency domain to generate two or more of the C playback channels in the frequency domain, where C>E≧1. The synthesizer applies one or more cue codes to each of the one or more different frequency bands in the two or more playback channels in the frequency domain to generate two or more modified channels. The one or more inverse filter banks convert the two or more modified channels from the frequency domain into a time domain.

Depending on the particular implementation, a given playback channel may be based on a single transmitted channel, rather than a combination of two or more transmitted channels. For example, when there is only one transmitted channel, each of the C playback channels is based on that one transmitted channel. In these situations, upmixing corresponds to copying of the corresponding transmitted channel. As such, for applications in which there is only one transmitted channel, the upmixer may be implemented using a replicator that copies the transmitted channel for each playback channel.

BCC encoders and/or decoders may be incorporated into a number of systems or applications including, for example, digital video recorders/players, digital audio recorders/players, computers, satellite transmitters/receivers, cable transmitters/receivers, terrestrial broadcast transmitters/receivers, home entertainment systems, and movie theater systems.

Generic BCC Processing

Figure 2:
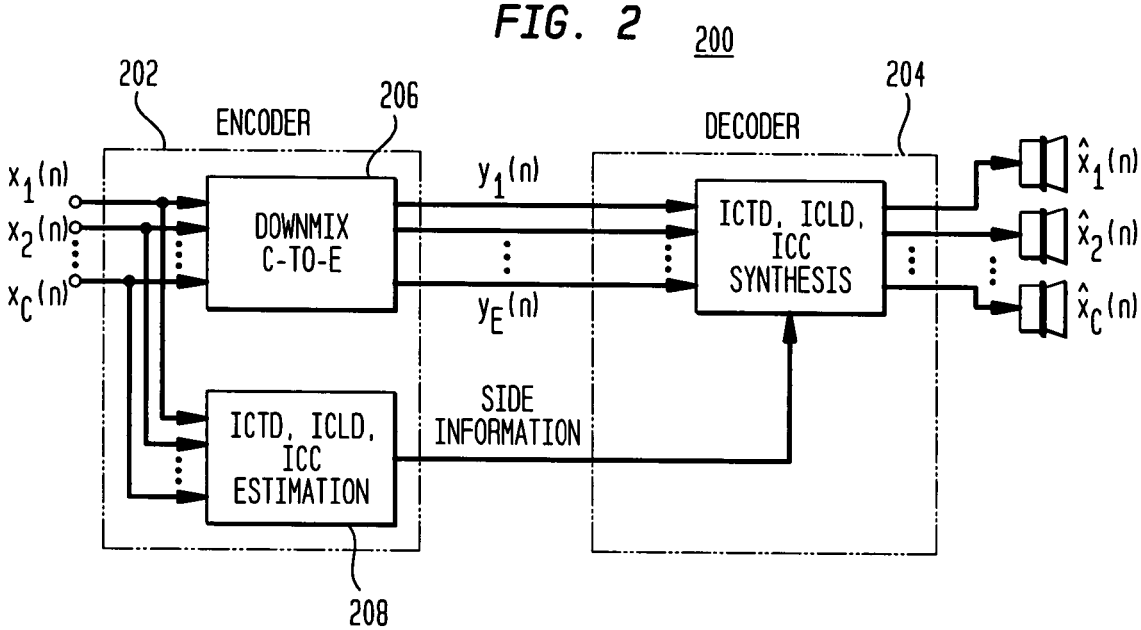
FIG. 2 is a block diagram of a generic binaural cue coding (BCC) audio processing system.

FIG. 2 is a block diagram of a generic binaural cue coding (BCC) audio processing system 200 comprising an encoder 202 and a decoder 204. Encoder 202 includes downmixer 206 and BCC estimator 208.

Downmixer 206 converts C input audio channels $x_i(n)$ into E transmitted audio channels $y_i(n)$, where $C>E\geqq 1$. In this specification, signals expressed using the variable n are time-domain signals, while signals expressed using the variable k are frequency-domain signals. Depending on the particular implementation, downmixing can be implemented in either the time domain or the frequency domain. BCC estimator 208 generates BCC codes from the C input audio channels and transmits those BCC codes as either in-band or out-of-band side information relative to the E transmitted audio channels. Typical BCC codes include one or more of inter-channel time difference (ICTD), inter-channel level difference (ICLD), and inter-channel correlation (ICC) data estimated between certain pairs of input channels as a function of frequency and time. The particular implementation will dictate between which particular pairs of input channels, BCC codes are estimated.

ICC data corresponds to the coherence of a binaural signal, which is related to the perceived width of the audio source. The wider the audio source, the lower the coherence between the left and right channels of the resulting binaural signal. For example, the coherence of the binaural signal corresponding to an orchestra spread out over an auditorium stage is typically lower than the coherence of the binaural signal corresponding to a single violin playing solo. In general, an audio signal with lower coherence is usually perceived as more spread out in auditory space. As such, ICC data is typically related to the apparent source width and degree of listener envelopment. See, e.g., J. Blauert, *The Psychophysics of Human Sound Localization*, MIT Press, 1983.

Depending on the particular application, the E transmitted audio channels and corresponding BCC codes may be transmitted directly to decoder 204 or stored in some suitable type of storage device for subsequent access by decoder 204. Depending on the situation, the term "transmitting" may refer to either direct transmission to a decoder or storage for subsequent provision to a decoder. In either case, decoder 204 receives the transmitted audio channels and side information and performs upmixing and BCC synthesis using the BCC codes to convert the E transmitted audio channels into more than E (typically, but not necessarily, C) playback audio channels $\hat{x}_i(n)$ for audio playback. Depending on the particular implementation, upmixing can be performed in either the time domain or the frequency domain.

In addition to the BCC processing shown in FIG. 2, a generic BCC audio processing system may include additional encoding and decoding stages to further compress the audio signals at the encoder and then decompress the audio signals at the decoder, respectively. These audio codecs may be based on conventional audio compression/decompression techniques such as those based on pulse code modulation (PCM), differential PCM (DPCM), or adaptive DPCM (ADPCM).

When downmixer 206 generates a single sum signal (i.e., E=1), BCC coding is able to represent multi-channel audio signals at a bitrate only slightly higher than what is required to represent a mono audio signal. This is so, because the estimated ICTD, ICLD, and ICC data between a channel pair contain about two orders of magnitude less information than an audio waveform.

Not only the low bitrate of BCC coding, but also its backwards compatibility aspect is of interest. A single transmitted sum signal corresponds to a mono downmix of the original stereo or multi-channel signal. For receivers that do not support stereo or multi-channel sound reproduction, listening to the transmitted sum signal is a valid method of presenting the audio material on low-profile mono reproduction equipment. BCC coding can therefore also be used to enhance existing services involving the delivery of mono audio material towards multi-channel audio. For example, existing mono audio radio broadcasting systems can be enhanced for stereo or multi-channel playback if the BCC side information can be embedded into the existing transmission channel. Analogous capabilities exist when downmixing multi-channel audio to two sum signals that correspond to stereo audio.

BCC processes audio signals with a certain time and frequency resolution. The frequency resolution used is largely motivated by the frequency resolution of the human auditory system. Psychoacoustics suggests that spatial perception is most likely based on a critical band representation of the acoustic input signal. This frequency resolution is considered by using an invertible filterbank (e.g., based on a fast Fourier transform (FFT) or a quadrature mirror filter (QMF)) with subbands with bandwidths equal or proportional to the critical bandwidth of the human auditory system.

Generic Downmixing

In preferred implementations, the transmitted sum signal (s) contain all signal components of the input audio signal. The goal is that each signal component is fully maintained. Simple summation of the audio input channels often results in amplification or attenuation of signal components. In other words, the power of the signal components in a "simple" sum is often larger or smaller than the sum of the power of the corresponding signal component of each channel. A downmixing technique can be used that equalizes the sum signal such that the power of signal components in the sum signal is approximately the same as the corresponding power in all input channels.

Figure 3:
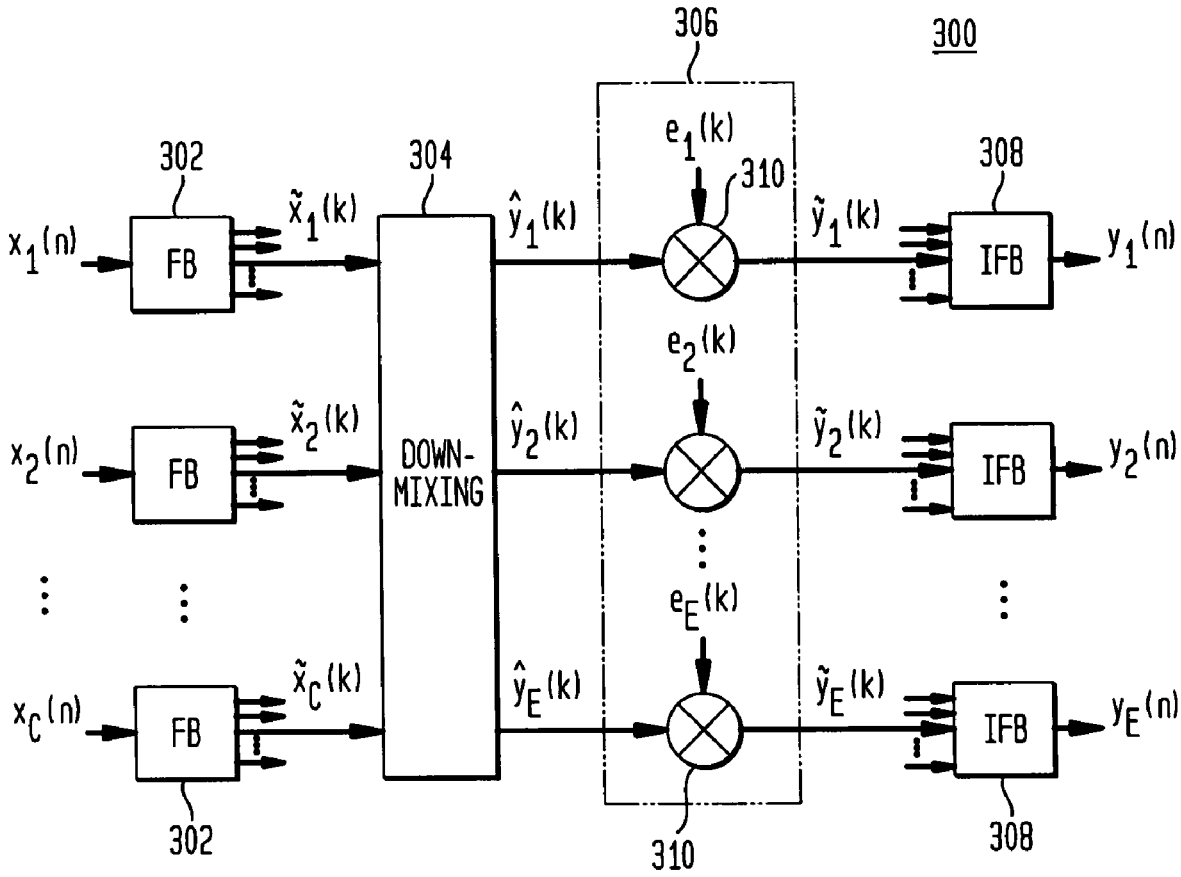
FIG. 3 shows a block diagram of a downmixer that can be used for the downmixer of FIG. 2.

FIG. 3 shows a block diagram of a downmixer 300 that can be used for downmixer 206 of FIG. 2 according to certain implementations of BCC system 200. Downmixer 300 has a filter bank (FB) 302 for each input channel $x_i(n)$, a downmixing block 304, an optional scaling/delay block 306, and an inverse FB (IFB) 308 for each encoded channel $y_i(n)$.

Each filter bank 302 converts each frame (e.g., 20 msec) of a corresponding digital input channel $x_i(n)$ in the time domain into a set of input coefficients $\tilde{x}_i(k)$ in the frequency domain. Downmixing block 304 downmixes each subband of C corresponding input coefficients into a corresponding subband of E downmixed frequency-domain coefficients. Equation (1) represents the downmixing of the kth subband of input coefficients ($\tilde{x}_1(k), \tilde{x}_2(k), \ldots, \tilde{x}_C(k)$) to generate the kth subband of downmixed coefficients ($\hat{y}_1(k), \hat{y}_2(k), \ldots, \hat{y}_E(k)$) as follows:

$$\begin{bmatrix} \hat{y}_1(k) \\ \hat{y}_2(k) \\ \vdots \\ \hat{y}_E(k) \end{bmatrix} = D_{CE} \begin{bmatrix} \tilde{x}_1(k) \\ \tilde{x}_2(k) \\ \vdots \\ \tilde{x}_C(k) \end{bmatrix}, \tag{1}$$

where $D_{CE}$ is a real-valued C-by-E downmixing matrix.

Optional scaling/delay block 306 comprises a set of multipliers 310, each of which multiplies a corresponding downmixed coefficient $\hat{y}_i(k)$ by a scaling factor $e_i(k)$ to generate a corresponding scaled coefficient $\tilde{y}_i(k)$. The motivation for the scaling operation is equivalent to equalization generalized for downmixing with arbitrary weighting factors for each channel. If the input channels are independent, then the power $p_{\tilde{y}_y(k)}$ of the downmixed signal in each subband is given by Equation (2) as follows:

$$\begin{bmatrix} p_{\tilde{y}_1(k)} \\ p_{\tilde{y}_1(k)} \\ \vdots \\ p_{\tilde{y}_E(k)} \end{bmatrix} = \overline{D}_{CE} \begin{bmatrix} p_{\tilde{x}_1(k)} \\ P_{\tilde{x}_2(k)} \\ \vdots \\ p_{\tilde{x}_C(k)} \end{bmatrix}, \tag{2}$$

where $\overline{D}_{CE}$ is derived by squaring each matrix element in the C-by-E downmixing matrix $D_{CE}$ and $p_{\tilde{x}_i(k)}$ is the power of subband k of input channel i.

If the subbands are not independent, then the power values $p_{\tilde{y}_i(k)}$ of the downmixed signal will be larger or smaller than that computed using Equation (2), due to signal amplifications or cancellations when signal components are in-phase or out-of-phase, respectively. To prevent this, the downmixing operation of Equation (1) is applied in subbands followed by the scaling operation of multipliers 310. The scaling factors $e_i(k)$ ($1 \geqq i \geqq E$) can be derived using Equation (3) as follows:

$$e_i(k) = \sqrt{\frac{p_{\tilde{y}_i(k)}}{p_{y_i(k)}}}, \tag{3}$$

where $p_{\tilde{y}_i(k)}$ is the subband power as computed by Equation (2), and $p_{\hat{y}_i(k)}$ is power of the corresponding downmixed subband signal $\hat{y}_i(k)$.

In addition to or instead of providing optional scaling, scaling/delay block 306 may optionally apply delays to the signals.

Each inverse filter bank 308 converts a set of corresponding scaled coefficients $\tilde{y}_i(k)$ in the frequency domain into a frame of a corresponding digital, transmitted channel $y_i(n)$.

Although FIG. 3 shows all C of the input channels being converted into the frequency domain for subsequent downmixing, in alternative implementations, one or more (but less than C−1) of the C input channels might bypass some or all of the processing shown in FIG. 3 and be transmitted as an equivalent number of unmodified audio channels. Depending on the particular implementation, these unmodified audio channels might or might not be used by BCC estimator 208 of FIG. 2 in generating the transmitted BCC codes.

In an implementation of downmixer 300 that generates a single sum signal y(n), E=1 and the signals $\tilde{x}_c(k)$ of each subband of each input channel c are added and then multiplied with a factor e(k), according to Equation (4) as follows:

$$\tilde{y}(k) = e(k) \sum_{c=1}^{C} \tilde{x}_c(k). \tag{4}$$

the factor e(k) is given by Equation (5) as follows:

$$e(k) = \sqrt{\frac{\sum_{c=1}^{C} p_{\tilde{x}_c}(k)}{p_{\tilde{x}}(k)}}, \tag{5}$$

where $p_{\tilde{x}_c}(k)$ is a short-time estimate of the power of $\tilde{x}_c(k)$ at time index k, and $p_{\tilde{x}}(k)$ is a short-time estimate of the power of $$\sum_{c=1}^{C} \tilde{x}_c(k).$$

The equalized subbands are transformed back to the time domain resulting in the sum signal y(n) that is transmitted to the BCC decoder.

Generic BCC Synthesis

Figure 4:
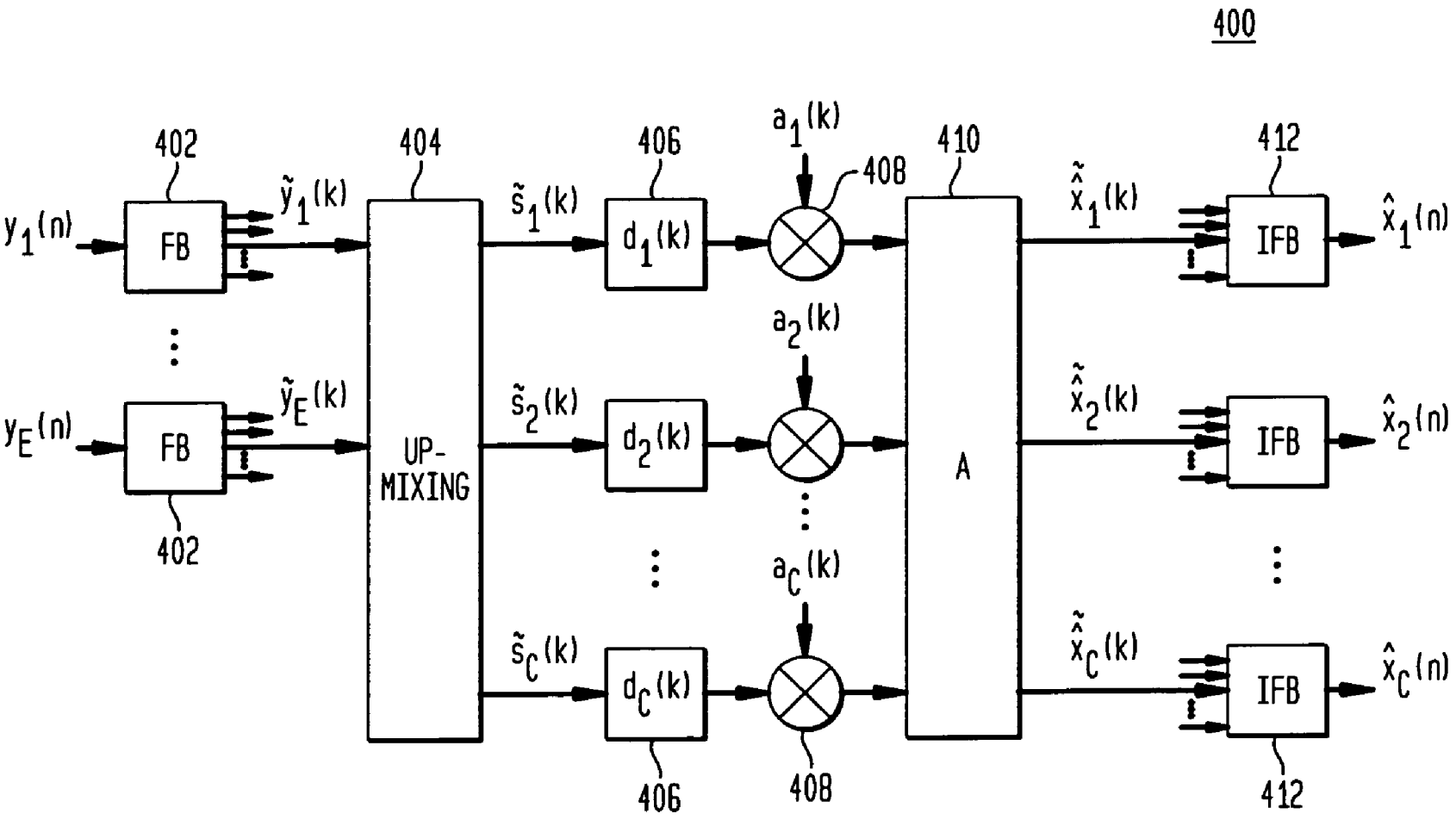
FIG. 4 shows a block diagram of a BCC synthesizer that can be used for the decoder of FIG. 2.

FIG. 4 shows a block diagram of a BCC synthesizer 400 that can be used for decoder 204 of FIG. 2 according to certain implementations of BCC system 200. BCC synthesizer 400 has a filter bank 402 for each transmitted channel $y_i(n)$, an upmixing block 404, delays 406, multipliers 408, de-correlation block 410, and an inverse filter bank 412 for each playback channel $\hat{x}_i(n)$.

Each filter bank 402 converts each frame of a corresponding digital, transmitted channel $y_i(n)$ in the time domain into a set of input coefficients $\tilde{y}_i(k)$ in the frequency domain. Upmixing block 404 upmixes each subband of E corresponding transmitted-channel coefficients into a corresponding subband of C upmixed frequency-domain coefficients. Equation (4) represents the upmixing of the kth subband of transmitted-channel coefficients ($\tilde{y}_1(k), \tilde{y}_2(k), \ldots, \tilde{y}_E(k)$) to generate the kth subband of upmixed coefficients ($\tilde{s}_1(k), \tilde{s}_2(k), \ldots, \tilde{s}_C(k)$) as follows:

$$\begin{bmatrix} \tilde{s}_1(k) \\ \tilde{s}_2(k) \\ \vdots \\ \tilde{s}_C(k) \end{bmatrix} = U_{EC} \begin{bmatrix} \tilde{y}_1(k) \\ \tilde{y}_2(k) \\ \vdots \\ \tilde{y}_E(k) \end{bmatrix}, \tag{6}$$

where $U_{EC}$ is a real-valued E-by-C upmixing matrix. Performing upmixing in the frequency-domain enables upmixing to be applied individually in each different subband.

Each delay 406 applies a delay value $d_i(k)$ based on a corresponding BCC code for ICTD data to ensure that the desired ICTD values appear between certain pairs of playback channels. Each multiplier 408 applies a scaling factor $a_i(k)$ based on a corresponding BCC code, for ICLD data to ensure that the desired ICLD values appear between certain pairs of playback channels. De-correlation block 410 performs a de-correlation operation A based on corresponding BCC codes for ICC data to ensure that the desired ICC values appear between certain pairs of playback channels. Further description of the operations of de-correlation block 410 can be found in U.S. patent application Ser. No. 10/155,437, filed on May 24, 2002.

The synthesis of ICLD values may be less troublesome than the synthesis of ICTD and ICC values, since ICLD synthesis involves merely scaling of subband signals. Since ICLD cues are the most commonly used directional cues, it is usually more important that the ICLD values approximate those of the original audio signal. As such, ICLD data might be estimated between all channel pairs. The scaling factors $a_i(k)$ ($1 \geqq i \geqq C$) for each subband are preferably chosen such that the subband power of each playback channel approximates the corresponding power of the original input audio channel.

One goal may be to apply relatively few signal modifications for synthesizing ICTD and ICC values. As such, the BCC data might not include ICTD and ICC values for all channel pairs. In that case, BCC synthesizer 400 would synthesize ICTD and ICC values only between certain channel pairs.

Each inverse filter bank 412 converts a set of corresponding synthesized coefficients $\tilde{\tilde{x}}_i(k)$ in the frequency domain into a frame of a corresponding digital, playback channel $\tilde{x}_i(n)$.

Although FIG. 4 shows all E of the transmitted channels being converted into the frequency domain for subsequent upmixing and BCC processing, in alternative implementations, one or more (but not all) of the E transmitted channels might bypass some or all of the processing shown in FIG. 4. For example, one or more of the transmitted channels may be unmodified channels that are not subjected to any upmixing. In addition to being one or more of the C playback channels, these unmodified channels, in turn, might be, but do not have to be, used as reference channels to which BCC processing is applied to synthesize one or more of the other playback channels. In either case, such unmodified channels may be subjected to delays to compensate for the processing time involved in the upmixing and/or BCC processing used to generate the rest of the playback channels.

Note that, although FIG. 4 shows C playback channels being synthesized from E transmitted channels, where C was also the number of original input channels, BCC synthesis is not limited to that number of playback channels. In general, the number of playback channels can be any number of channels, including numbers greater than or less than C and possibly even situations where the number of playback channels is equal to or less than the number of transmitted channels.

"Perceptually Relevant Differences" Between Audio Channels

Assuming a single sum signal, BCC synthesizes a stereo or multi-channel audio signal such that ICTD, ICLD, and ICC approximate the corresponding cues of the original audio signal. In the following, the role of ICTD, ICLD, and ICC in relation to auditory spatial image attributes is discussed.

Knowledge about spatial hearing implies that for one auditory event, ICTD and ICLD are related to perceived direction. When considering binaural room impulse responses (BRIRs) of one source, there is a relationship between width of the auditory event and listener envelopment and ICC data estimated for the early and late parts of the BRIRs. However, the relationship between ICC and these properties for general signals (and not just the BRIRs) is not straightforward.

Stereo and multi-channel audio signals usually contain a complex mix of concurrently active source signals superimposed by reflected signal components resulting from recording in enclosed spaces or added by the recording engineer for artificially creating a spatial impression. Different source signals and their reflections occupy different regions in the time-frequency plane. This is reflected by ICTD, ICLD, and ICC, which vary as a function of time and frequency. In this case, the relation between instantaneous ICTD, ICLD, and ICC and auditory event directions and spatial impression is not obvious. The strategy of certain embodiments of BCC is to blindly synthesize these cues such that they approximate the corresponding cues of the original audio signal.

Filterbanks with subbands of bandwidths equal to two times the equivalent rectangular bandwidth (ERB) are used. Informal listening reveals that the audio quality of BCC does not notably improve when choosing higher frequency resolution. A lower frequency resolution may be desired, since it results in fewer ICTD, ICLD, and ICC values that need to be transmitted to the decoder and thus in a lower bitrate.

Regarding time resolution, ICTD, ICLD, and ICC are typically considered at regular time intervals. High performance is obtained when ICTD, ICLD, and ICC are considered about every 4 to 16 ms. Note that, unless the cues are considered at very short time intervals, the precedence effect is not directly considered. Assuming a classical lead-lag pair of sound stimuli, if the lead and lag fall into a time interval where only one set of cues is synthesized, then localization dominance of the lead is not considered. Despite this, BCC achieves audio quality reflected in an average MUSHRA score of about 87 (i.e., "excellent" audio quality) on average and up to nearly 100 for certain audio signals.

The often-achieved perceptually small difference between reference signal and synthesized signal implies that cues related to a wide range of auditory spatial image attributes are implicitly considered by synthesizing ICTD, ICLD, and ICC at regular time intervals. In the following, some arguments are given on how ICTD, ICLD, and ICC may relate to a range of auditory spatial image attributes.

Estimation of Spatial Cues

In the following, it is described how ICTD, ICLD, and ICC are estimated. The bitrate for transmission of these (quantized and coded) spatial cues can be just a few kb/s and thus, with BCC, it is possible to transmit stereo and multi-channel audio signals at bitrates close to what is required for a single audio channel.

Figure 5:
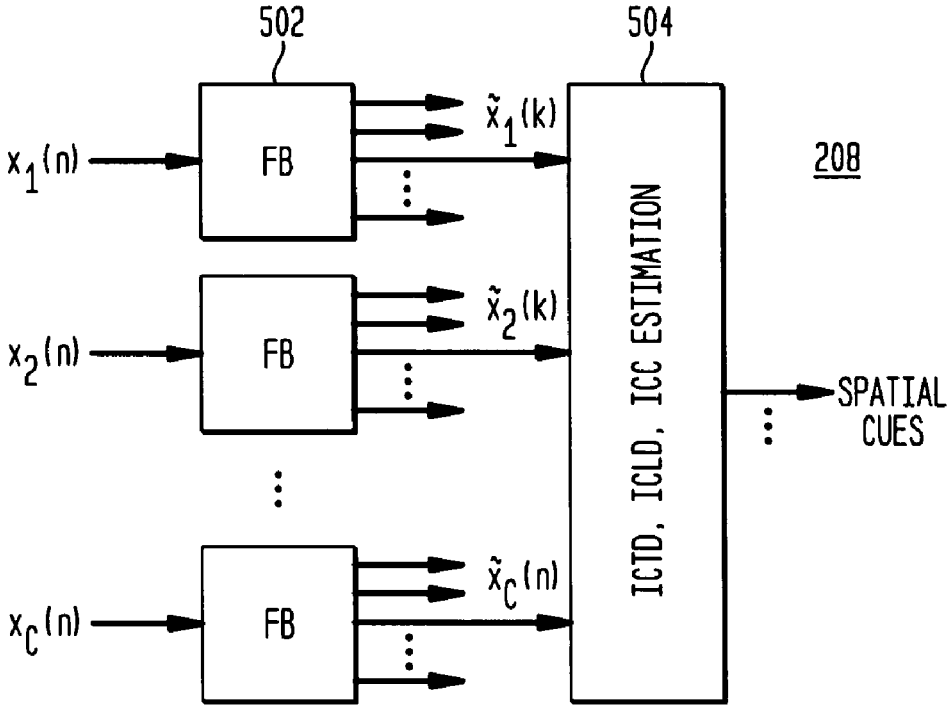
FIG. 5 shows a block diagram of the BCC estimator of FIG. 2, according to one embodiment of the present invention.

FIG. 5 shows a block diagram of BCC estimator 208 of FIG. 2, according to one embodiment of the present invention. BCC estimator 208 comprises filterbanks (FB) 502, which may be the same as filterbanks 302 of FIG. 3, and estimation block 504, which generates ICTD, ICLD, and ICC spatial cues for each different frequency subband generated by filterbanks 502.

Estimation of ICTD, ICLD, and ICC for Stereo Signals

The following measures are used for ICTD, ICLD, and ICC for corresponding subband signals $\tilde{x}_1(k)$ and $\tilde{x}_2(k)$ of two (e.g., stereo) audio channels:

ICTD [Samples]:

$$\tau_{12}(k) = \underset{d}{\operatorname{argmax}}\{\Phi_{12}(d, k)\}, \tag{7}$$

with a short-time estimate of the normalized cross-correlation function given by Equation (8) as follows:

$$\Phi_{12}(d,k)=\frac{p_{\tilde{x}_1\tilde{x}_2}(d,k)}{\sqrt{p_{\tilde{x}_1}(k-d_1)p_{\tilde{x}_2}(k-d_2)}},\tag{8}$$

where $$d_1=\max\{-d,0\}\qquad d_2=\max\{d,0\},\tag{9}$$

and $p_{\tilde{x}_1\tilde{x}_2}(d,k)$ is a short-time estimate of the mean of $\tilde{x}_1(k-d_1)\tilde{x}_2(k-d_2)$.

ICLD [dB]:

$$\Delta L_{12}(k)=10\log_{10}\left(\frac{p_{\tilde{x}_2}(k)}{p_{\tilde{x}_1}(k)}\right).\tag{10}$$

*ICC*:

$$c_{12}(k)=\max_d|\Phi_{12}(d,k)|.\tag{11}$$

Note that the absolute value of the normalized cross-correlation is considered and $c_{12}(k)$ has a range of [0,1].

Estimation of ICTD, ICLD, and ICC for Multi-Channel Audio Signals

Figure 6:
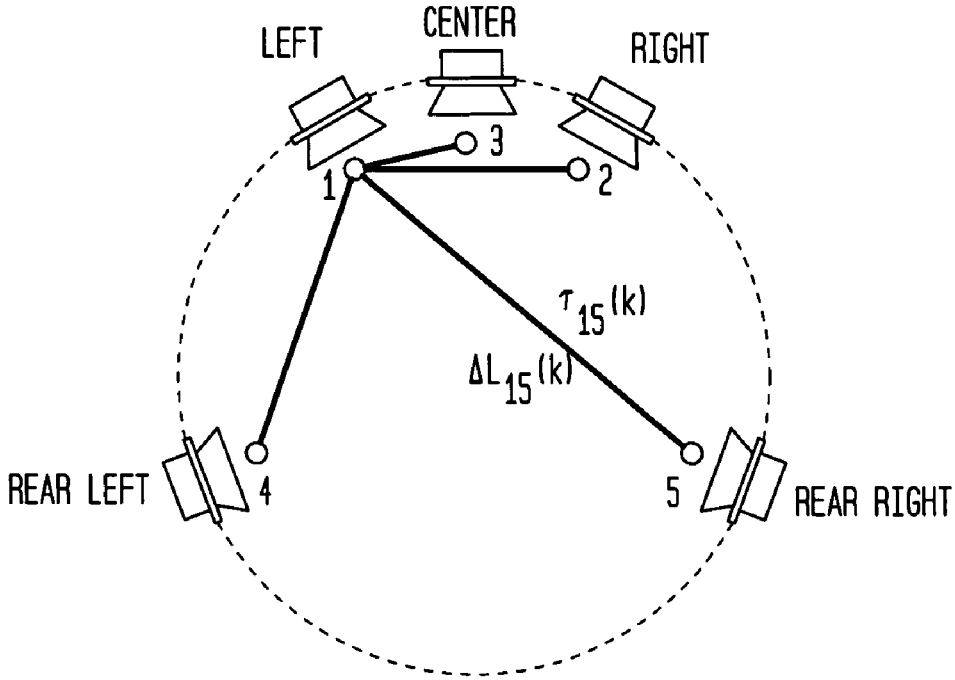
FIG. 6 illustrates the generation of ICTD and ICLD data for five-channel audio.

When there are more than two input channels, it is typically sufficient to define ICTD and ICLD between a reference channel (e.g., channel number 1) and the other channels, as illustrated in FIG. 6 for the case of C=5 channels. where $\tau_{1c}$ and $\Delta L_{1c}(k)$ denote the ICTD and ICLD, respectively, between the reference channel 1 and channel c.

As opposed to ICTD and ICLD, ICC typically has more degrees of freedom. The ICC as defined can have different values between all possible input channel pairs. For C channels, there are C(C−1)/2 possible channel pairs; e.g., for 5 channels there are 10 channel pairs as illustrated in FIG. 7(*a*). However, such a scheme requires that, for each subband at each time index, C(C−1)/2 ICC values are estimated and transmitted, resulting in high computational complexity and high bitrate.

Alternatively, for each subband, ICTD and ICLD determine the direction at which the auditory event of the corresponding signal component in the subband is rendered. One single ICC parameter per subband may then be used to describe the overall coherence between all audio channels. Good results can be obtained by estimating and transmitting ICC cues only between the two channels with most energy in each subband at each time index. This is illustrated in FIG. 7(*b*), where for time instants k−1 and k the channel pairs (3, 4) and (1, 2) are strongest, respectively. A heuristic rule may be used for determining ICC between the other channel pairs.

Synthesis of Spatial Cues

Figure 8:
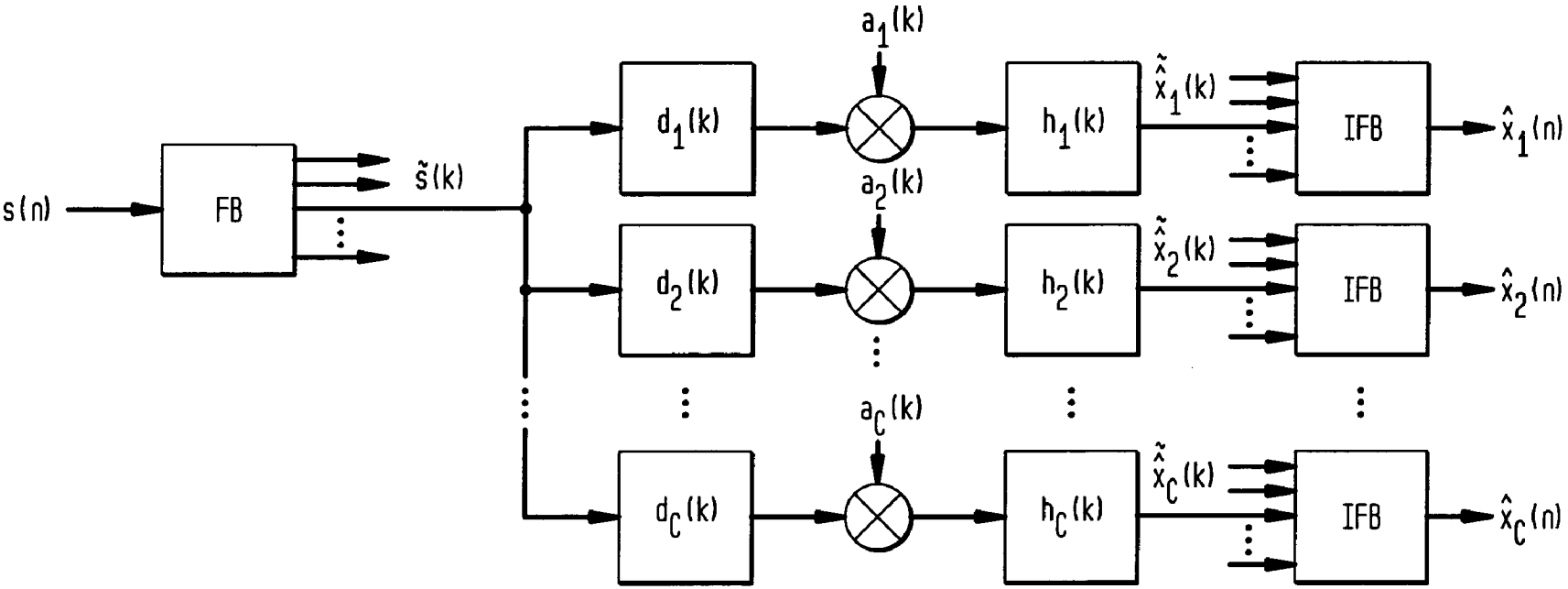
FIG. 8 shows a block diagram of an implementation of the BCC synthesizer of FIG. 4 that can be used in a BCC decoder to generate a stereo or multi-channel audio signal given a single transmitted sum signal s(n) plus the spatial cues.

FIG. 8 shows a block diagram of an implementation of BCC synthesizer 400 of FIG. 4 that can be used in a BCC decoder to generate a stereo or multi-channel audio signal given a single transmitted sum signal s(n) plus the spatial cues. The sum signal s(n) is decomposed into subbands, where $\tilde{s}(k)$ denotes one such subband. For generating the corresponding subbands of each of the output channels, delays $d_c$, scale factors $a_c$, and filters $h_c$ are applied to the corresponding subband of the sum signal. (For simplicity of notation, the time index k is ignored in the delays, scale factors, and filters.) ICTD are synthesized by imposing delays, ICLD by scaling, and ICC by applying de-correlation filters. The processing shown in FIG. 8 is applied independently to each subband.

ICTD Synthesis

The delays $d_c$ are determined from the ICTDs $\tau_{1c}(k)$, according to Equation (12) as follows:

$$d_c=\begin{cases}-\frac{1}{2}(\max_{2\le l\le C}\tau_{1l}(k)+\min_{2\le l\le C}\tau_{1l}(k)), & c=1\\ \tau_{1l}(k)+d_1 & 2\le c\le C.\end{cases}\tag{12}$$

The delay for the reference channel, $d_1$, is computed such that the maximum magnitude of the delays $d_c$ is minimized. The less the subband signals are modified, the less there is a danger for artifacts to occur. If the subband sampling rate does not provide high enough time-resolution for ICTD synthesis, delays can be imposed more precisely by using suitable all-pass filters.

ICLD Synthesis

In order that the output subband signals have desired ICLDs $\Delta L_{12}(k)$ between channel c and the reference channel 1, the gain factors $a_c$ should satisfy Equation (13) as follows:

$$\frac{a_c}{a_1}=10^{\frac{\Delta L_{1c}(k)}{20}}.\tag{13}$$

Additionally, the output subbands are preferably normalized such that the sum of the power of all output channels is equal to the power of the input sum signal. Since the total original signal power in each subband is preserved in the sum signal, this normalization results in the absolute subband power for each output channel approximating the corresponding power of the original encoder input audio signal. Given these constraints, the scale factors $a_c$ are given by Equation (14) as follows:

$$a_c=\begin{cases}1\Big/\sqrt{1+\sum_{i=2}^{C}10^{\Delta L_{1i}/10}}, & c=1\\ 10^{\Delta L_{1c}/20}a_1, & \text{otherwise.}\end{cases}\tag{14}$$

ICC Synthesis

In certain embodiments, the aim of ICC synthesis is to reduce correlation between the subbands after delays and scaling have been applied, without affecting ICTD and ICLD. This can be achieved by designing the filters $h_c$ in FIG. 8 such that ICTD and ICLD are effectively varied as a function of frequency such that the average variation is zero in each subband (auditory critical band).

Figure 9:
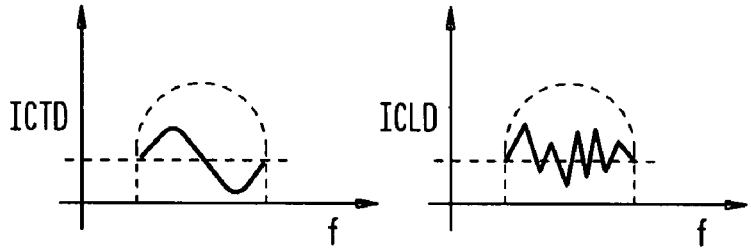
FIG. 9 illustrates how ICTD and ICLD are varied within a subband as a function of frequency.

FIG. 9 illustrates how ICTD and ICLD are varied within a subband as a function of frequency. The amplitude of ICTD and ICLD variation determines the degree of de-correlation and is controlled as a function of ICC. Note that ICTD are varied smoothly (as in FIG. 9(*a*)), while ICLD are varied randomly (as in FIG. 9(*b*)). One could vary ICLD as smoothly as ICTD, but this would result in more coloration of the resulting audio signals.

Another method for synthesizing ICC, particularly suitable for multi-channel ICC synthesis, is described in more detail in C. Faller, "Parametric multi-channel audio coding: Synthesis of coherence cues," *IEEE Trans. on Speech and Audio Proc.*, 2003, the teachings of which are incorporated herein by reference. As a function of time and frequency, specific amounts of artificial late reverberation are added to each of the output channels for achieving a desired ICC. Additionally, spectral modification can be applied such that the spectral envelope of the resulting signal approaches the spectral envelope of the original audio signal.

Other related and unrelated ICC synthesis techniques for stereo signals (or audio channel pairs) have been presented in E. Schuijers, W. Oomen, B. den Brinker, and J. Breebaart, "Advances in parametric coding for high-quality audio," in *Preprint* 114$^{th}$ *Conv. Aud. Eng. Soc.*, March 2003, and J. Engdegard, H. Purnhagen, J. Roden, and L. Liljeryd, "Synthetic ambience in parametric stereo coding," in *Preprint* 117$^{th}$ *Conv. Aud. Eng. Soc.*, May 2004, the teachings of both of which are incorporated here by reference.

C-to-E BCC

As described previously, BCC can be implemented with more than one transmission channel. A variation of BCC has been described which represents C audio channels not as one single (transmitted) channel, but as E channels, denoted C-to-E BCC. There are (at least) two motivations for C-to-E BCC:

- BCC with one transmission channel provides a backwards compatible path for upgrading existing mono systems for stereo or multi-channel audio playback. The upgraded systems transmit the BCC downmixed sum signal through the existing mono infrastructure, while additionally transmitting the BCC side information. C-to-E BCC is applicable to E-channel backwards compatible coding of C-channel audio.
- C-to-E BCC introduces scalability in terms of different degrees of reduction of the number of transmitted channels. It is expected that the more audio channels that are transmitted, the better the audio quality will be.

Signal processing details for C-to-E BCC, such as how to define the ICTD, ICLD, and ICC cues, are described in U.S. application Ser. No. 10/762,100, filed on Jan. 20, 2004.

Object-Based BCC Cues

Figure 7A:
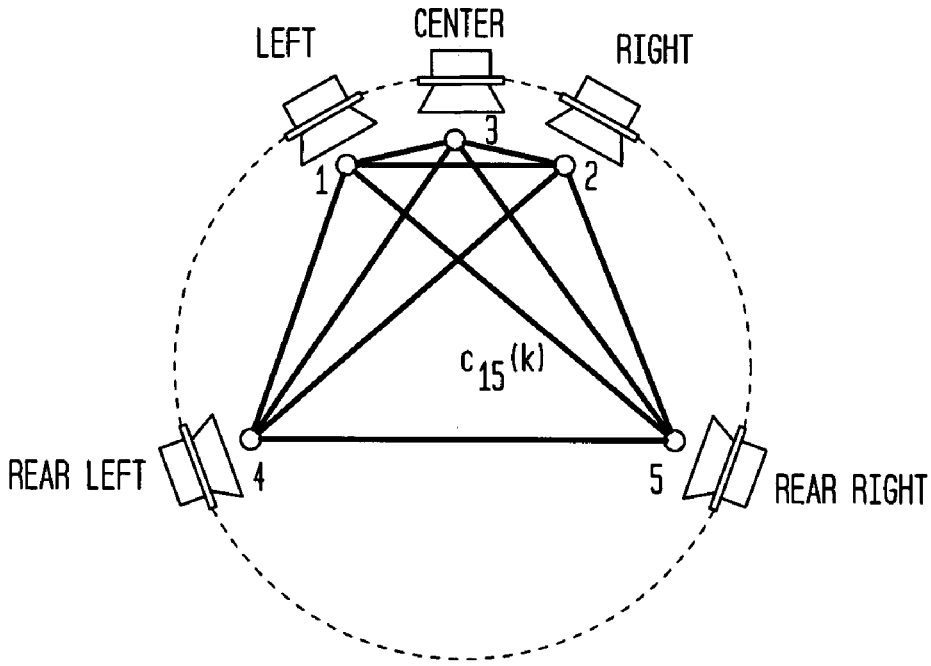
FIG. 7 illustrates the generation of ICC data for five-channel audio.
Figure 7B:
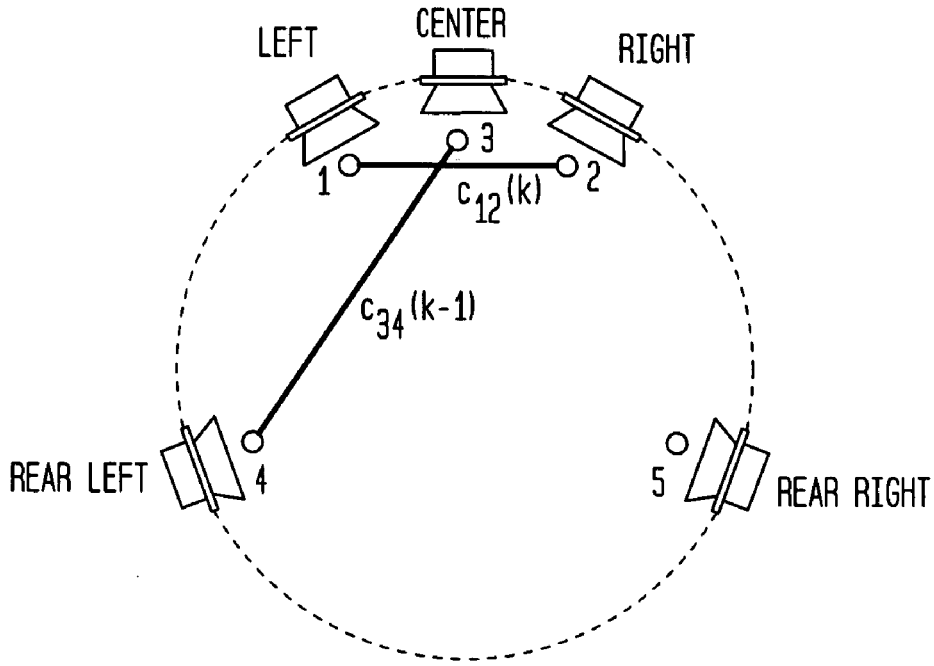

As described above, in a conventional C-to-E BCC scheme, the encoder derives statistical inter-channel difference parameters (e.g., ICTD, ICLD, and/or ICC cues) from C original channels. As represented in FIGS. 6 and 7A-B, these particular BCC cues are functions of the number and positions of the loudspeakers used to create the auditory spatial image. These BCC cues are referred to as "non-object-based" BCC cues, since they do not directly represent perceptual attributes of the auditory spatial image.

In addition to or instead of one or more of such non-object-based BCC cues, a BCC scheme may include one or more "object-based" BCC cues that directly represent attributes of the auditory spatial image inherent in multi-channel surround audio signals. As used in this specification, an object-based cue is a cue that directly represents a characteristic of an auditory scene, where the characteristic is independent of the number and positions of loudspeakers used to create that scene. The auditory scene itself will depend on the number and location of the speakers used to create it, but not the object-based BCC cues themselves.

Assume, for example, that (1) a first audio scene is generated using a first configuration of speakers and (2) a second audio scene is generated using a second configuration of speakers (e.g., having a different number and/or locations of speakers from the first configuration). Assume further that the first audio scene is identical to the second audio scene (at least from the perspective of a particular listener). In that case, non-object-based BCC cues (e.g., ICTDs, ICLDs, ICCs) for the first audio scene will be different from the non-object-based BCC cues for the second audio scene, but object-based BCC cues for both audio scenes will be the same, because those cues characterize the audio scenes directly (i.e., independent of the number and locations of speakers).

BCC schemes are often applied in the context of particular signal formats (e.g., 5-channel surround), where the number and locations of loudspeakers are specified by the signal format. In such applications, any non-object-based BCC cues will depend on the signal format, while any object-based BCC cues may be said to be independent of the signal format in that they are independent of the number and positions of loudspeakers associated with that signal format.

Figure 10A:
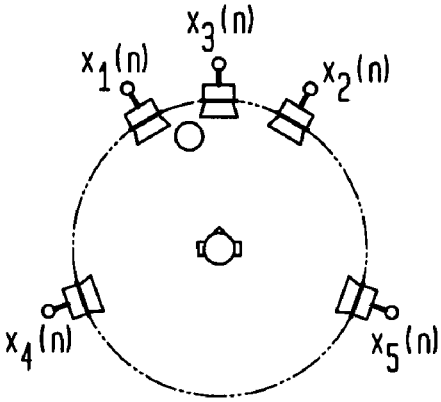
FIG. 10(*a*) illustrates a listener perceiving a single, relatively focused auditory event (represented by the shaded circle) at a certain angle.
Figure 10B:
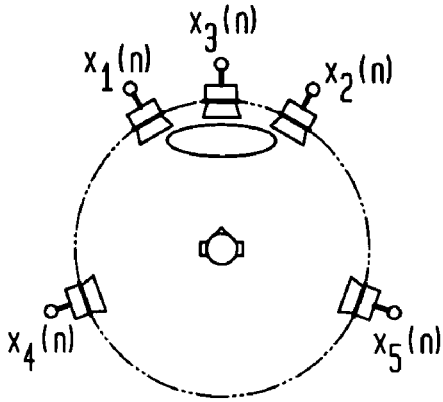

FIG. 10(*a*) illustrates a listener perceiving a single, relatively focused auditory event (represented by the shaded circle) at a certain angle. Such an auditory event can be generated by applying "amplitude panning" to the pair of loudspeakers enclosing the auditory event (i.e., loudspeakers 1 and 3 in FIG. 10(*a*)), where the same signal is sent to the two loudspeakers, but with possibly different strengths. The level difference (e.g., ICLD) determines where the auditory event appears between the loudspeaker pair. With this technique, an auditory event can be rendered at any direction by appropriate selection of the loudspeaker pair and ICLD value.

FIG. 10(*b*) illustrates a listener perceiving a single, more diffuse auditory event (represented by the shaded oval). Such an auditory event can be rendered at any direction using the same amplitude panning technique as described for FIG. 10(*a*). In addition, the similarity between the signal pair is reduced (e.g., using the ICC coherence parameter). For ICC=1, the auditory event is focused as in FIG. 10(*a*), and, as ICC decreases, the width of the auditory event increases as in FIG. 10(*b*).

Figure 11A:
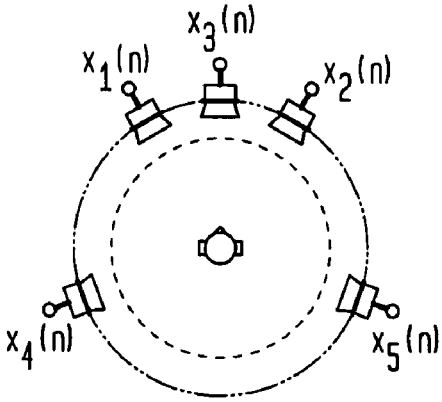
FIG. 11(*a*) illustrates another kind of perception, often referred to as listener envelopment, in which independent audio signals are applied to loudspeakers all around a listener such that the listener feels "enveloped" in the sound field.
Figure 11B:
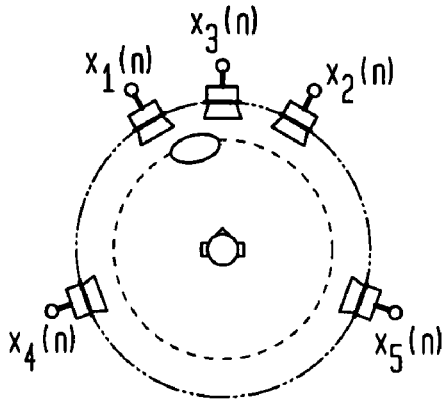

FIG. 11(*a*) illustrates another kind of perception, often referred to as listener envelopment, in which independent audio signals are applied to loudspeakers all around a listener such that the listener feels "enveloped" in the sound field. This impression can be created by applying differently de-correlated versions of an audio signal to different loudspeakers.

FIG. 11(*b*) illustrates a listener being enveloped in a sound field, while perceiving an auditory event of a certain width at a certain angle. This auditory scene can be created by applying a signal to the loudspeaker pair enclosing the auditory event (i.e., loudspeakers 1 and 3 in FIG. 11(*b*)), while applying the same amount of independent (i.e., de-correlated) signals to all loudspeakers.

According to one embodiment of the present invention, the spatial aspect of audio signals is parameterized as a function of frequency (e.g., in subbands) and time, for scenarios such as those illustrated in FIG. 11(*b*). Rather than estimating and transmitting non-object-based BCC cues such as ICTD, ICLD, and ICC cues, this particular embodiment uses object-based parameters that more directly represent spatial aspects of the auditory scene, as the BCC cues. In particular, in each subband b at each time k, the angle $\alpha(b,k)$ of the auditory event, the width $w(b,k)$ of the auditory event, and the degree of envelopment $e(b,k)$ of the auditory scene are estimated and transmitted as BCC cues.

Figure 12A:
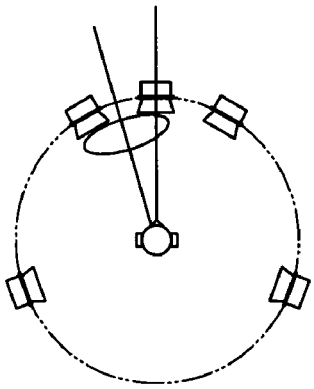
FIGS. 12(*a*)-(*c*) illustrate three different auditory scenes and the values of their associated object-based BCC cues.
Figure 12B:
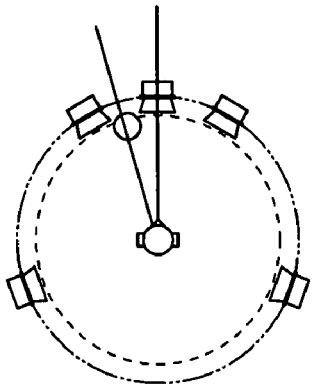
Figure 12C:
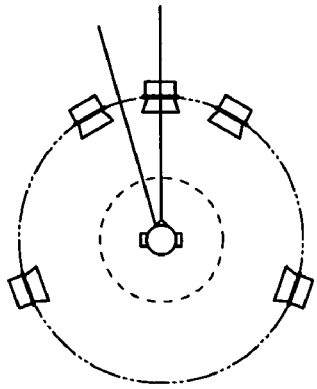

FIGS. 12(*a*)-(*c*) illustrate three different auditory scenes and the values of their associated object-based BCC cues. In the auditory scene of FIG. 12(*c*), there is no localized auditory event. As such, the width $w(b,k)$ is zero and the angle $\alpha(b,k)$ is arbitrary.

Encoder Processing

FIGS. 10-12 illustrate one possible 5-channel surround configuration, in which the left loudspeaker (#1) is located 30° to the left of the center loudspeaker (#3), the right loudspeaker (#2) is located 30° to the right of the center loudspeaker, the left rear loudspeaker (#4) is located 110° to the left of the center loudspeaker, and the right rear loudspeaker (#5) is located 110° to the right of the center loudspeaker.

Figure 13:
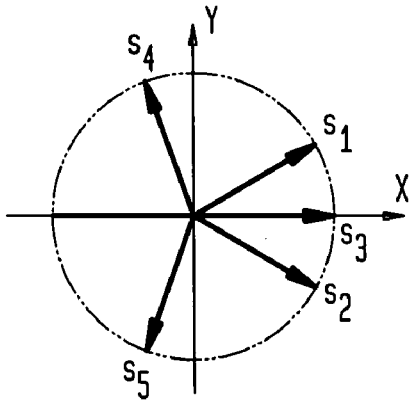
FIG. 13 graphically represents the orientations of the five loudspeakers of FIGS. 10-12.

FIG. 13 graphically represents the orientations of the five loudspeakers of FIGS. 10-12 as unit vectors $s_i=(\cos\phi_i, \sin\phi_i)^T$, where the X-axis represents the orientation of the center loudspeaker, the Y-axis represents an orientation 90° to the left of the center loudspeaker, and $\phi_1$ are the loudspeaker angles relative to the X-axis.

At each time k, in each BCC subband b, the direction of the auditory event in the surround image can be estimated according to Equation (15) as follows:

$$\alpha(b,k) = \angle\sum_{i=1}^{5} p_i(b,k)s_i, \tag{15}$$

where $\alpha(b,k)$ is the estimated angle of the auditory event with respect to the X-axis of FIG. 13, and $p_i(b,k)$ is the power or magnitude of surround channel i in subband b at time index k. If the magnitude is used, then Equation (15) corresponds to the particle velocity vector of the sound field in the sweet spot. The power has also often been used, especially for high frequencies, where sound intensities and head shadowing play a more important role.

The width w(b,k) of the auditory event can be estimated according to Equation (16) as follows:

$$w(b,k)=1-ICC(b,k), \tag{16}$$

where ICC(b,k) is a coherence estimate between the signals for the two loudspeakers enclosing the direction defined by the angle $\alpha(b,k)$.

The degree of envelopment e(b,k) of the auditory scene estimates the total amount of de-correlated sound coming out of all loudspeakers. This measure can be computed as a coherence estimate between various channel pairs combined with some considerations as a function of the power $p_i(b,k)$. For example, e(b,k) could be a weighted average of coherence estimation obtained between different audio channel pairs, where the weighting is a function of the relative powers of the different audio channel pairs.

Another possible way of estimating the direction of the auditory event would be to select, at each time k and in each subband b, the two strongest channels and compute the level difference between these two channels. An amplitude panning law can then be used to compute the relative angle of the auditory event between the two selected loudspeakers. The relative angle between the two loudspeakers can then be converted to the absolute angle $\alpha(b,k)$.

In this alternative technique, the width w(b,k) of the auditory event can be estimated using Equation (16), where ICC (b,k) is the coherence estimate between the two strongest channels, and the degree of envelopment e(b,k) of the auditory scene can be estimated using Equation (17), as follows:

$$e(b,k) = \frac{\sum_{i\neq i_1, i\neq i_2}^{C} p_i(b,k)}{\sum_{i=1}^{C} p_i(b,k)}, \tag{17}$$

where C is the number of channels, and $i_1$ and $i_2$ are the indices of the two selected strongest channels.

Although a BCC scheme could transmit all three object-based parameters (i.e., $\alpha(b,k)$, w(b,k), and e(b,k)), an alternative BCC scheme might transmit fewer parameters, e.g., when very low bitrate is needed. For example, fairly good results can be obtained using only two parameters: direction $\alpha(b,k)$ and "directionality" d(b,k), where the directionality parameter combines w(b,k) and e(b,k) into one parameter based on a weighted average between w(b,k) and e(b,k).

The combination of w(b,k) and e(b,k) is motivated by the fact that the width of auditory events and degree of envelopment are somewhat related perceptions. Both are evoked by lateral independent sound. Thus, combination of w(b,k) and e(b,k) results in only a little less flexibility in terms of determining the attributes of the auditory spatial image. In one possible implementation, the weighting of w(b,k) and e(b,k) reflects the total signal power of the signals with which w(b,k) and e(b,k) have been computed. For example, the weight for w(b,k) can be chosen proportional to the power of the two channels that were selected for computation of w(b,k), and the weight for w(b,k) could be proportional to the power of all channels. Alternatively, $\alpha(b,k)$ and w(b,k) could be transmitted, where e(b,k) is determined heuristically at the decoder.

Decoder Processing

The decoder processing can be implemented by converting the object-based BCC cues into non-object-based BCC cues, such as level differences (ICLD) and coherence values (ICC), and then using those non-object-based BCC cues in a conventional BCC decoder.

For example, the angle $\alpha(b,k)$ of the auditory event can be used to determine the ICLD between the two loudspeaker channels enclosing the auditory event by applying an amplitude-panning law (or other possible frequency-dependent relation). When amplitude panning is applied, scale factors $a_1$ and $a_2$ may be estimated from the stereophonic law of sines given by Equation (18) as follows:

$$\frac{\sin\phi}{\sin\phi_0} = \frac{a_1 - a_2}{a_1 + a_2}, \tag{18}$$

where $\phi_0$ is the magnitude of the half of the angle between the two loudspeakers, $\phi$ is the corresponding angle of the auditory event relative to the angle of the loudspeaker most close in the clockwise direction (if the angles are defined to increase in the counterclockwise direction), and the scale factors $a_1$ and $a_2$ are related to the level-difference cue ICLD, according to Equation (19) as follows:

$$\Delta L_{12}(k)=20\log_{10}(a_2/a_1). \tag{19}$$

Figure 14:
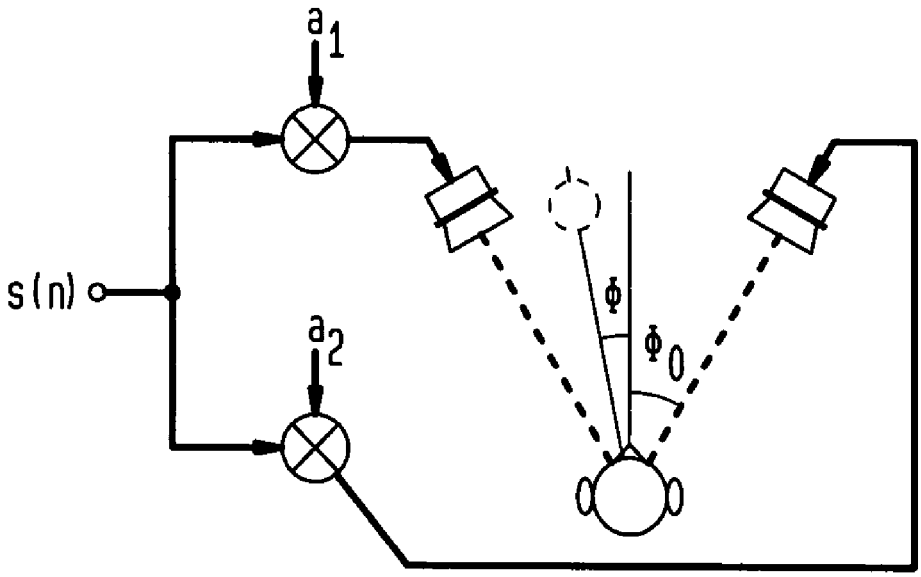
FIG. 14 illustrates the angles and the scale factors for amplitude panning.
Figure 15:
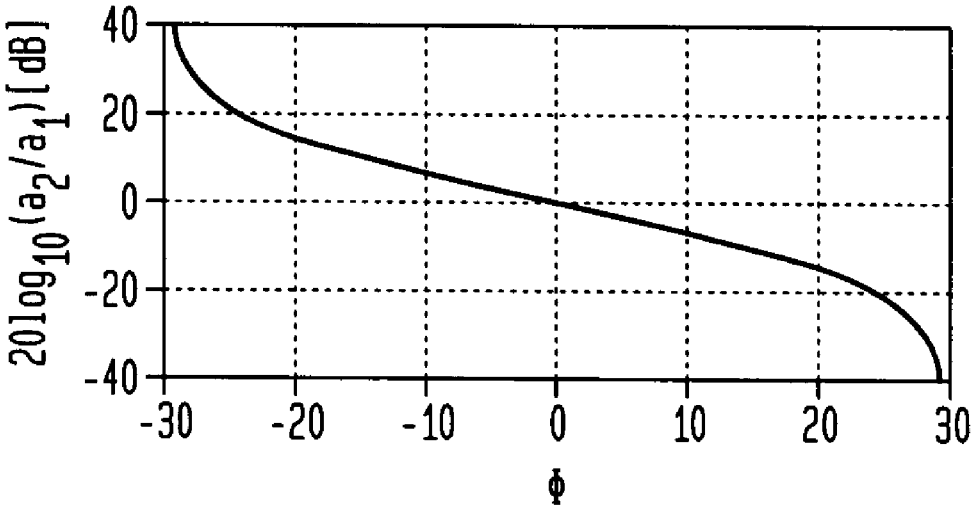
FIG. 15 graphically represents the relationship between ICLD and the stereo event angle, according to the stereophonic law of sines.

FIG. 14 illustrates the angles $\phi_0$ and $\phi$ and the scale factors $a_1$ and $a_2$, where s(n) represents a mono signal that appears at angle $\phi$ when amplitude panning is applied based on the scale factors $a_1$ and $a_2$. FIG. 15 graphically represents the relationship between ICLD and the stereo event angle $\phi$ according to the stereophonic law of sines of Equation (18) for a standard stereo configuration with $\phi_0$=30°.

As described previously, the scale factors $a_1$ and $a_2$ are determined as a function of the direction of the auditory event. Since Equation (18) determines only the ratio $a_2/a_1$, there is one degree of freedom for the overall scaling of $a_1$ and $a_2$. This scaling also depends on other cues, e.g., w(b,k) and e(b,k).

The coherence cue ICC between the two loudspeaker channels enclosing the auditory event can be determined from the width parameter w(b,k) as ICC(b,k)=1−w(b,k). The power of each remaining channel i is computed as a function of the degree of envelopment parameter e(b,k), where larger values of e(b,k) imply more power given to the remaining channels. Since the total power is a constant (i.e., the total power is equal or proportional to the total power of the transmitted channels), the sum of power given to the two channels enclosing the auditory event direction plus the sum of power of all remaining channels (determined by e(b,k)) is constant. Thus, the higher the degree of envelopment e(b,k), the less power is relatively given to the localized sound, i.e., the smaller are $a_1$ and $a_2$ chosen (while the ratio $a_2/a_1$ is as determined from the direction of the auditory event).

One extreme case is when there is a maximum degree of envelopment. In this case, $a_1$ and $a_2$ are small, or even $a_1=a_2=0$. The other extreme is minimum degree of envelopment. In this case, $a_1$ and $a_2$ are chosen such that all signal power goes to these two channels, while the power of the remaining channels is zero. The signal that is given to the remaining channels is preferably an independent (de-correlated) signal in order to get the maximum effect of listener envelopment.

One characteristic of object-based BCC cues, such as $\alpha(b,k)$, w(b,k), and e(b,k), is that they are independent of the number and the positions of the loudspeakers. As such, these object-based BCC cues can be efficiently used to render an auditory scene for any number of loudspeakers at any positions.

Further Alternative Embodiments

Although the present invention has been described in the context of BCC coding schemes in which cue codes are transmitted with one or more audio channels (i.e., the E transmitted channels), in alternative embodiments, the cue codes could be transmitted to a place (e.g., a decoder or a storage device) that already has the transmitted channels and possibly other BCC codes.

Although the present invention has been described in the context of BCC coding schemes, the present invention can also be implemented in the context of other audio processing systems in which audio signals are de-correlated or other audio processing that needs to de-correlate signals.

Although the present invention has been described in the context of implementations in which the encoder receives input audio signal in the time domain and generates transmitted audio signals in the time domain and the decoder receives the transmitted audio signals in the time domain and generates playback audio signals in the time domain, the present invention is not so limited. For example, in other implementations, any one or more of the input, transmitted, and playback audio signals could be represented in a frequency domain.

BCC encoders and/or decoders may be used in conjunction with or incorporated into a variety of different applications or systems, including systems for television or electronic music distribution, movie theaters, broadcasting, streaming, and/or reception. These include systems for encoding/decoding transmissions via, for example, terrestrial, satellite, cable, interne, intranets, or physical media (e.g., compact discs, digital versatile discs, semiconductor chips, hard drives, memory cards, and the like). BCC encoders and/or decoders may also be employed in games and game systems, including, for example, interactive software products intended to interact with a user for entertainment (action, role play, strategy, adventure, simulations, racing, sports, arcade, card, and board games) and/or education that may be published for multiple machines, platforms, or media. Further, BCC encoders and/or decoders may be incorporated in audio recorders/players or CD-ROM/DVD systems. BCC encoders and/or decoders may also be incorporated into PC software applications that incorporate digital decoding (e.g., player, decoder) and software applications incorporating digital encoding capabilities (e.g., encoder, ripper, recoder, and jukebox).

The present invention may be implemented as circuit-based processes, including possible implementation as a single integrated circuit (such as an ASIC or an FPGA), a multi-chip module, a single card, or a multi-card circuit pack. As would be apparent to one skilled in the art, various functions of circuit elements may also be implemented as processing steps in a software program. Such software may be employed in, for example, a digital signal processor, microcontroller, or general-purpose computer.

The present invention can be embodied in the form of methods and apparatuses for practicing those methods. The present invention can also be embodied in the form of program code embodied in tangible media, such as floppy diskettes, CD-ROMs, hard drives, or any other machine-readable storage medium, wherein, when the program code is loaded into and executed by a machine, such as a computer, the machine becomes an apparatus for practicing the invention. The present invention can also be embodied in the form of program code, for example, whether stored in a storage medium, loaded into and/or executed by a machine, or transmitted over some transmission medium or carrier, such as over electrical wiring or cabling, through fiber optics, or via electromagnetic radiation, wherein, when the program code is loaded into and executed by a machine, such as a computer, the machine becomes an apparatus for practicing the invention. When implemented on a general-purpose processor, the program code segments combine with the processor to provide a unique device that operates analogously to specific logic circuits.

The present invention can also be embodied in the form of a bitstream or other sequence of signal values electrically or optically transmitted through a medium, stored magnetic-field variations in a magnetic recording medium, etc., generated using a method and/or an apparatus of the present invention.

It will be further understood that various changes in the details, materials, and arrangements of the parts which have been described and illustrated in order to explain the nature of this invention may be made by those skilled in the art without departing from the scope of the invention as expressed in the following claims.

Although the steps in the following method claims, if any, are recited in a particular sequence with corresponding labeling, unless the claim recitations otherwise imply a particular sequence for implementing some or all of those steps, those steps are not necessarily intended to be limited to being implemented in that particular sequence.

I claim:

1. A method for encoding audio channels, the method comprising:

generating one or more cue codes for two or more audio channels, wherein at least one cue code is an object-based cue code that directly represents a characteristic of an auditory scene corresponding to the audio channels, where the characteristic is independent of number and positions of audio sources used to create the auditory scene; and transmitting the one or more cue codes, wherein the at least one object-based cue code comprises one or more of:

(1) a first measure of an absolute angle of an auditory event in the auditory scene relative to a reference direction, wherein the first measure of the absolute angle of the auditory event is estimated by:

(i) generating a vector sum of relative power vectors for the audio channels; and (ii) determining the first measure of the absolute angle of the auditory event based on the angle of the vector sum relative to the reference direction;

(2) a second measure of the absolute angle of the auditory event in the auditory scene relative to the reference direction, wherein the second measure of the absolute angle of the auditory event is estimated by:

(i) identifying the two strongest channels in the audio channels;

(ii) computing a level difference between the two strongest channels;

(iii) applying an amplitude panning law to compute a relative angle between the two strongest channels; and (iv) converting the relative angle into the second measure of the absolute angle of the auditory event;

(3) a first measure of a width of the auditory event in the auditory scene, wherein the first measure of the width of the auditory event is estimated by:

(i) estimating the absolute angle of the auditory event;

(ii) identifying two audio channels enclosing the absolute angle;

(iii) estimating coherence between the two identified channels; and (iv) calculating the first measure of the width of the auditory event based on the estimated coherence;

(4) a second measure of the width of the auditory event in the auditory scene, wherein the second measure of the width of the auditory event is estimated by:

(i) identifying the two strongest channels in the audio channels;

(ii) estimating coherence between the two strongest channels; and (iii) calculating the second measure of the width of the auditory event based on the estimated coherence;

(5) a first degree of envelopment of the auditory scene, wherein the first degree of envelopment is estimated as a weighted average of coherence estimates obtained between different audio channel pairs, where the weighting is a function of the relative powers of the different audio channel pairs;

(6) a second degree of envelopment of the auditory scene, wherein the second degree of envelopment is estimated as a ratio of (i) the sum of the powers of all but the two strongest audio channels and (ii) the sum of the powers of all of the audio channels; and (7) directionality of the auditory scene, wherein the directionality is a weighted sum of the width of the auditory event and the degree of envelopment of the auditory scene.

2. The invention of claim 1, further comprising transmitting E transmitted audio channel(s) corresponding to the two or more audio channels, where $E \geqq 1$.

3. The invention of claim 2, wherein:

the two or more audio channels comprise C input audio channels, where $C>E$; and the C input channels are downmixed to generate the E transmitted channel(s).

4. The invention of claim 1, wherein the one or more cue codes are transmitted to enable a decoder to perform synthesis processing during decoding of E transmitted channel(s) based on the at least one object-based cue code, wherein the E transmitted audio channel(s) correspond to the two or more audio channels, where $E \geqq 1$.

5. The invention of claim 1, wherein the at least one object-based cue code is estimated at different times and in different subbands.

6. The invention of claim 1, wherein the at least one object-based cue code comprises two or more of (1) the first measure of the absolute angle of the auditory event in the auditory scene relative to the reference direction; (2) the second measure of the absolute angle of the auditory event in the auditory scene relative to the reference direction; (3) the first measure of the width of the auditory event; (4) the second measure of the width of the auditory event; (5) the first degree of envelopment of the auditory scene; (6) the second degree of envelopment of the auditory scene; and (7) the directionality of the auditory scene.

7. The invention of claim 1, wherein the at least one object-based cue code comprises the first measure of the absolute angle of the auditory event in the auditory scene relative to the reference direction.

8. The invention of claim 1, wherein the at least one object-based cue code comprises the second measure of the absolute angle of the auditory event in the auditory scene.

9. The invention of claim 1, wherein the at least one object-based cue code comprises the first measure of the width of the auditory event in the auditory scene.

10. The invention of claim 1, wherein the at least one object-based cue code comprises the second measure of the width of the auditory event in the auditory scene.

11. The invention of claim 1, wherein the at least one object-based cue code comprises the first degree of envelopment of the auditory scene.

12. The invention of claim 1, wherein the at least one object-based cue code comprises the second degree of envelopment of the auditory scene.

13. The invention of claim 1, wherein the at least one object-based cue code comprises the directionality of the auditory scene.

14. The invention of claim 13, wherein the directionality is estimated by:

(i) estimating the width of the auditory event in the auditory scene;

(ii) estimating the degree of envelopment of the auditory scene; and (iii) calculating the directionality as a weighted sum of the width and the degree of envelopment.

15. Apparatus for encoding audio channels, the apparatus comprising:

means for generating one or more cue codes for two or more audio channels, wherein at least one cue code is an object-based cue code that directly represents a characteristic of an auditory scene corresponding to the audio channels, where the characteristic is independent of number and positions of audio sources used to create the auditory scene; and means for transmitting the one or more cue codes, wherein the at least one object-based cue code comprises one or more of:

(1) a first measure of an absolute angle of an auditory event in the auditory scene relative to a reference direction, wherein the first measure of the absolute angle of the auditory event is estimated by:

(i) generating a vector sum of relative power vectors for the audio channels; and (ii) determining the first measure of the absolute angle of the auditory event based on the angle of the vector sum relative to the reference direction;

(2) a second measure of the absolute angle of the auditory event in the auditory scene relative to the reference direction, wherein the second measure of the absolute angle of the auditory event is estimated by:

(i) identifying the two strongest channels in the audio channels;

(ii) computing a level difference between the two strongest channels;

(iii) applying an amplitude panning law to compute a relative angle between the two strongest channels; and (iv) converting the relative angle into the second measure of the absolute angle of the auditory event;

(3) a first measure of a width of the auditory event in the auditory scene, wherein the first measure of the width of the auditory event is estimated by:

(i) estimating the absolute angle of the auditory event;

(ii) identifying two audio channels enclosing the absolute angle;

(iii) estimating coherence between the two identified channels; and (iv) calculating the first measure of the width of the auditory event based on the estimated coherence;

(4) a second measure of the width of the auditory event in the auditory scene, wherein the second measure of the width of the auditory event is estimated by:

(i) identifying the two strongest channels in the audio channels;

(ii) estimating coherence between the two strongest channels; and (iii) calculating the second measure of the width of the auditory event based on the estimated coherence;

(5) a first degree of envelopment of the auditory scene, wherein the first degree of envelopment is estimated as a weighted average of coherence estimates obtained between different audio channel pairs, where the weighting is a function of the relative powers of the different audio channel pairs;

(6) a second degree of envelopment of the auditory scene, wherein the second degree of envelopment is estimated as a ratio of (i) the sum of the powers of all but the two strongest audio channels and (ii) the sum of the powers of all of the audio channels; and (7) directionality of the auditory scene, wherein the directionality is a weighted sum of the width of the auditory event and the degree of envelopment of the auditory scene.

16. Apparatus for encoding C input audio channels to generate E transmitted audio channel(s), the apparatus comprising:

a code estimator adapted to generate one or more cue codes for two or more audio channels, wherein at least one cue code is an object-based cue code that directly represents a characteristic of an auditory scene corresponding to the audio channels, where the characteristic is independent of number and positions of audio sources used to create the auditory scene; and a downmixer adapted to downmix the C input channels to generate the E transmitted channel(s), where $C>E\geqq 1$, wherein the apparatus is adapted to transmit information about the cue codes to enable a decoder to perform synthesis processing during decoding of the E transmitted channel(s), wherein the at least one object-based cue code comprises one or more of:

(1) a first measure of an absolute angle of an auditory event in the auditory scene relative to a reference direction, wherein the first measure of the absolute angle of the auditory event is estimated by:

(i) generating a vector sum of relative power vectors for the audio channels; and (ii) determining the first measure of the absolute angle of the auditory event based on the angle of the vector sum relative to the reference direction;

(2) a second measure of the absolute angle of the auditory event in the auditory scene relative to the reference direction, wherein the second measure of the absolute angle of the auditory event is estimated by:

(i) identifying the two strongest channels in the audio channels;

(ii) computing a level difference between the two strongest channels;

(iii) applying an amplitude panning law to compute a relative angle between the two strongest channels; and (iv) converting the relative angle into the second measure of the absolute angle of the auditory event;

(3) a first measure of a width of the auditory event in the auditory scene, wherein the first measure of the width of the auditory event is estimated by:

(i) estimating the absolute angle of the auditory event;

(ii) identifying two audio channels enclosing the absolute angle;

(iii) estimating coherence between the two identified channels; and (iv) calculating the first measure of the width of the auditory event based on the estimated coherence;

(4) a second measure of the width of the auditory event in the auditory scene, wherein the second measure of the width of the auditory event is estimated by:

(i) identifying the two strongest channels in the audio channels;

(ii) estimating coherence between the two strongest channels; and (iii) calculating the second measure of the width of the auditory event based on the estimated coherence;

(5) a first degree of envelopment of the auditory scene, wherein the first degree of envelopment is estimated as a weighted average of coherence estimates obtained between different audio channel pairs, where the weighting is a function of the relative powers of the different audio channel pairs;

(6) a second degree of envelopment of the auditory scene, wherein the second degree of envelopment is estimated as a ratio of (i) the sum of the powers of all but the two strongest audio channels and (ii) the sum of the powers of all of the audio channels; and (7) directionality of the auditory scene, wherein the directionality is a weighted sum of the width of the auditory event and the degree of envelopment of the auditory scene.

17. The apparatus of claim 16, wherein:

the apparatus is a system selected from the group consisting of a digital video recorder, a digital audio recorder, a computer, a satellite transmitter, a cable transmitter, a terrestrial broadcast transmitter, a home entertainment system, and a movie theater system; and the system comprises the code estimator and the downmixer.

18. A non-transitory machine-readable storage medium, having encoded thereon program code, wherein, when the program code is executed by a machine, the machine implements a method for encoding audio channels, the method comprising:

generating one or more cue codes for two or more audio channels, wherein at least one cue code is an object-based cue code that directly represents a characteristic of an auditory scene corresponding to the audio channels, where the characteristic is independent of number and positions of audio sources used to create the auditory scene; and transmitting the one or more cue codes, wherein the at least one object-based cue code comprises one or more of:

(1) a first measure of an absolute angle of an auditory event in the auditory scene relative to a reference direction, wherein the first measure of the absolute angle of the auditory event is estimated by:

(i) generating a vector sum of relative power vectors for the audio channels; and (ii) determining the first measure of the absolute angle of the auditory event based on the angle of the vector sum relative to the reference direction;

(2) a second measure of the absolute angle of the auditory event in the auditory scene relative to the reference direction, wherein the second measure of the absolute angle of the auditory event is estimated by:

(i) identifying the two strongest channels in the audio channels;

(ii) computing a level difference between the two strongest channels;

(iii) applying an amplitude panning law to compute a relative angle between the two strongest channels; and (iv) converting the relative angle into the second measure of the absolute angle of the auditory event;

(3) a first measure of a width of the auditory event in the auditory scene, wherein the first measure of the width of the auditory event is estimated by:

(i) estimating the absolute angle of the auditory event;

(ii) identifying two audio channels enclosing the absolute angle;

(iii) estimating coherence between the two identified channels; and (iv) calculating the first measure of the width of the auditory event based on the estimated coherence;

(4) a second measure of the width of the auditory event in the auditory scene, wherein the second measure of the width of the auditory event is estimated by:

(i) identifying the two strongest channels in the audio channels;

(ii) estimating coherence between the two strongest channels; and (iii) calculating the second measure of the width of the auditory event based on the estimated coherence;

(5) a first degree of envelopment of the auditory scene, wherein the first degree of envelopment is estimated as a weighted average of coherence estimates obtained between different audio channel pairs, where the weighting is a function of the relative powers of the different audio channel pairs;

(6) a second degree of envelopment of the auditory scene, wherein the second degree of envelopment is estimated as a ratio of (i) the sum of the powers of all but the two strongest audio channels and (ii) the sum of the powers of all of the audio channels; and (7) directionality of the auditory scene, wherein the directionality is a weighted sum of the width of the auditory event and the degree of envelopment of the auditory scene.

19. An encoded audio bitstream generated by encoding audio channels, wherein:

one or more cue codes are generated for two or more audio channels, wherein at least one cue code is an object-based cue code that directly represents a characteristic of an auditory scene corresponding to the audio channels, where the characteristic is independent of number and positions of audio sources used to create the auditory scene; and the one or more cue codes and E transmitted audio channel(s) corresponding to the two or more audio channels, where $E \geqq 1$, are encoded into the encoded audio bitstream, wherein the at least one object-based cue code comprises one or more of:

(1) a first measure of an absolute angle of an auditory event in the auditory scene relative to a reference direction, wherein the first measure of the absolute angle of the auditory event is estimated by:

(i) generating a vector sum of relative power vectors for the audio channels; and (ii) determining the first measure of the absolute angle of the auditory event based on the angle of the vector sum relative to the reference direction;

(2) a second measure of the absolute angle of the auditory event in the auditory scene relative to the reference direction, wherein the second measure of the absolute angle of the auditory event is estimated by:

(i) identifying the two strongest channels in the audio channels;

(ii) computing a level difference between the two strongest channels;

(iii) applying an amplitude panning law to compute a relative angle between the two strongest channels; and (iv) converting the relative angle into the second measure of the absolute angle of the auditory event;

(3) a first measure of a width of the auditory event in the auditory scene, wherein the first measure of the width of the auditory event is estimated by:

(i) estimating the absolute angle of the auditory event;

(ii) identifying two audio channels enclosing the absolute angle;

(iii) estimating coherence between the two identified channels; and (iv) calculating the first measure of the width of the auditory event based on the estimated coherence;

(4) a second measure of the width of the auditory event in the auditory scene, wherein the second measure of the width of the auditory event is estimated by:

(i) identifying the two strongest channels in the audio channels;

(ii) estimating coherence between the two strongest channels; and (iii) calculating the second measure of the width of the auditory event based on the estimated coherence;

(5) a first degree of envelopment of the auditory scene, wherein the first degree of envelopment is estimated as a weighted average of coherence estimates obtained between different audio channel pairs, where the weighting is a function of the relative powers of the different audio channel pairs;

(6) a second degree of envelopment of the auditory scene, wherein the second degree of envelopment is estimated as a ratio of (i) the sum of the powers of all but the two strongest audio channels and (ii) the sum of the powers of all of the audio channels; and (7) directionality of the auditory scene, wherein the directionality is a weighted sum of the width of the auditory event and the degree of envelopment of the auditory scene.

20. A method for decoding E transmitted audio channel(s) to generate C playback audio channels, where $C > E \geqq 1$, the method comprising:

receiving cue codes corresponding to the E transmitted channel(s), wherein at least one cue code is an object-based cue code that directly represents a characteristic of an auditory scene corresponding to the audio channels, where the characteristic is independent of number and positions of audio sources used to create the auditory scene;

upmixing one or more of the E transmitted channel(s) to generate one or more upmixed channels; and synthesizing one or more of the C playback channels by applying the cue codes to the one or more upmixed channels, wherein the at least one object-based cue code comprises one or more of:

(1) a first measure of an absolute angle of an auditory event in the auditory scene relative to a reference direction, wherein the first measure of the absolute angle of the auditory event is estimated by:

(i) generating a vector sum of relative power vectors for the audio channels; and (ii) determining the first measure of the absolute angle of the auditory event based on the angle of the vector sum relative to the reference direction;

(2) a second measure of the absolute angle of the auditory event in the auditory scene relative to the reference direction, wherein the second measure of the absolute angle of the auditory event is estimated by:

(i) identifying the two strongest channels in the audio channels;

(ii) computing a level difference between the two strongest channels;

(iii) applying an amplitude panning law to compute a relative angle between the two strongest channels; and (iv) converting the relative angle into the second measure of the absolute angle of the auditory event;

(3) a first measure of a width of the auditory event in the auditory scene, wherein the first measure of the width of the auditory event is estimated by:

(i) estimating the absolute angle of the auditory event;

(ii) identifying two audio channels enclosing the absolute angle;

(iii) estimating coherence between the two identified channels; and (iv) calculating the first measure of the width of the auditory event based on the estimated coherence;

(4) a second measure of the width of the auditory event in the auditory scene, wherein the second measure of the width of the auditory event is estimated by:

(i) identifying the two strongest channels in the audio channels;

(ii) estimating coherence between the two strongest channels; and (iii) calculating the second measure of the width of the auditory event based on the estimated coherence;

(5) a first degree of envelopment of the auditory scene, wherein the first degree of envelopment is estimated as a weighted average of coherence estimates obtained between different audio channel pairs, where the weighting is a function of the relative powers of the different audio channel pairs;

(6) a second degree of envelopment of the auditory scene, wherein the second degree of envelopment is estimated as a ratio of (i) the sum of the powers of all but the two strongest audio channels and (ii) the sum of the powers of all of the audio channels; and (7) directionality of the auditory scene, wherein the directionality is a weighted sum of the width of the auditory event and the degree of envelopment of the auditory scene.

21. The invention of claim 20, wherein at least two playback channels are synthesized by:

(i) converting the at least one object-based cue code into at least one non-object-based cue code based on position of two or more audio sources used to render the playback audio channels; and (ii) applying the at least one non-object-based cue code to at least one upmixed channel to generate the at least two playback channels.

22. The invention of claim 21, wherein:

the at least one object-based cue code comprises two or more of (1) the first measure of the absolute angle of the auditory event in the auditory scene relative to the reference direction; (2) the second measure of the absolute angle of the auditory event in the auditory scene relative to the reference direction; (3) the first measure of the width of the auditory event; (4) the second measure of the width of the auditory event; (5) the first degree of envelopment of the auditory scene; (6) the second degree of envelopment of the auditory scene; and (7) the directionality of the auditory scene; and the at least one non-object-based cue code comprises one or more of (1) an inter-channel correlation (ICC) code, an inter-channel level difference (ICLD) code, and an inter-channel time difference (ICTD) code.

23. The invention of claim 20, wherein the at least one object-based cue code comprises at least one of the first and second measures of the absolute angle of the auditory event in the auditory scene relative to the reference direction.

24. The invention of claim 20, wherein the at least one object-based cue code comprises at least one of the first and second measures of the width of the auditory event in the auditory scene.

25. The invention of claim 20, wherein the at least one object-based cue code comprises at least one of the first and second degrees of envelopment of the auditory scene.

26. The invention of claim 20, wherein the at least one object-based cue code comprises the directionality of the auditory scene.

27. Apparatus for decoding E transmitted audio channel(s) to generate C playback audio channels, where $C>E\geqq 1$, the apparatus comprising:

means for receiving cue codes corresponding to the E transmitted channel(s), wherein at least one cue code is an object-based cue code that directly represents a characteristic of an auditory scene corresponding to the audio channels, where the characteristic is independent of number and positions of audio sources used to create the auditory scene;

means for upmixing one or more of the E transmitted channel(s) to generate one or more upmixed channels; and means for synthesizing one or more of the C playback channels by applying the cue codes to the one or more upmixed channels, wherein the at least one object-based cue code comprises one or more of:

(1) a first measure of an absolute angle of an auditory event in the auditory scene relative to a reference direction, wherein the first measure of the absolute angle of the auditory event is estimated by:

(i) generating a vector sum of relative power vectors for the audio channels; and (ii) determining the first measure of the absolute angle of the auditory event based on the angle of the vector sum relative to the reference direction;

(2) a second measure of the absolute angle of the auditory event in the auditory scene relative to the reference direction, wherein the second measure of the absolute angle of the auditory event is estimated by:

(i) identifying the two strongest channels in the audio channels;

(ii) computing a level difference between the two strongest channels;

(iii) applying an amplitude panning law to compute a relative angle between the two strongest channels; and (iv) converting the relative angle into the second measure of the absolute angle of the auditory event;

(3) a first measure of a width of the auditory event in the auditory scene, wherein the first measure of the width of the auditory event is estimated by:

(i) estimating the absolute angle of the auditory event;

(ii) identifying two audio channels enclosing the absolute angle;

(iii) estimating coherence between the two identified channels; and (iv) calculating the first measure of the width of the auditory event based on the estimated coherence;

(4) a second measure of the width of the auditory event in the auditory scene, wherein the second measure of the width of the auditory event is estimated by:

(i) identifying the two strongest channels in the audio channels;

(ii) estimating coherence between the two strongest channels; and (iii) calculating the second measure of the width of the auditory event based on the estimated coherence;

(5) a first degree of envelopment of the auditory scene, wherein the first degree of envelopment is estimated as a weighted average of coherence estimates obtained between different audio channel pairs, where the weighting is a function of the relative powers of the different audio channel pairs;

(6) a second degree of envelopment of the auditory scene, wherein the second degree of envelopment is estimated as a ratio of (i) the sum of the powers of all but the two strongest audio channels and (ii) the sum of the powers of all of the audio channels; and (7) directionality of the auditory scene, wherein the directionality is a weighted sum of the width of the auditory event and the degree of envelopment of the auditory scene.

28. Apparatus for decoding E transmitted audio channel(s) to generate C playback audio channels, where $C>E\geqq 1$, the apparatus comprising:

a receiver adapted to receive cue codes corresponding to the E transmitted channel(s), wherein at least one cue code is an object-based cue code that directly represents a characteristic of an auditory scene corresponding to the audio channels, where the characteristic is independent of number and positions of audio sources used to create the auditory scene;

an upmixer adapted to upmix one or more of the E transmitted channel(s) to generate one or more upmixed channels; and a synthesizer adapted to synthesize one or more of the C playback channels by applying the cue codes to the one or more upmixed channels, wherein the at least one object-based cue code comprises one or more of:

(1) a first measure of an absolute angle of an auditory event in the auditory scene relative to a reference direction, wherein the first measure of the absolute angle of the auditory event is estimated by:

(i) generating a vector sum of relative power vectors for the audio channels; and (ii) determining the first measure of the absolute angle of the auditory event based on the angle of the vector sum relative to the reference direction;

(2) a second measure of the absolute angle of the auditory event in the auditory scene relative to the reference direction, wherein the second measure of the absolute angle of the auditory event is estimated by:

(i) identifying the two strongest channels in the audio channels;

(ii) computing a level difference between the two strongest channels;

(iii) applying an amplitude panning law to compute a relative angle between the two strongest channels; and (iv) converting the relative angle into the second measure of the absolute angle of the auditory event;

(3) a first measure of a width of the auditory event in the auditory scene, wherein the first measure of the width of the auditory event is estimated by:

(i) estimating the absolute angle of the auditory event;

(ii) identifying two audio channels enclosing the absolute angle;

(iii) estimating coherence between the two identified channels; and (iv) calculating the first measure of the width of the auditory event based on the estimated coherence;

(4) a second measure of the width of the auditory event in the auditory scene, wherein the second measure of the width of the auditory event is estimated by:

(i) identifying the two strongest channels in the audio channels;

(ii) estimating coherence between the two strongest channels; and (iii) calculating the second measure of the width of the auditory event based on the estimated coherence;

(5) a first degree of envelopment of the auditory scene, wherein the first degree of envelopment is estimated as a weighted average of coherence estimates obtained between different audio channel pairs, where the weighting is a function of the relative powers of the different audio channel pairs;

(6) a second degree of envelopment of the auditory scene, wherein the second degree of envelopment is estimated as a ratio of (i) the sum of the powers of all but the two strongest audio channels and (ii) the sum of the powers of all of the audio channels; and (7) directionality of the auditory scene, wherein the directionality is a weighted sum of the width of the auditory event and the degree of envelopment of the auditory scene.

29. The apparatus of claim 28, wherein:

the apparatus is a system selected from the group consisting of a digital video player, a digital audio player, a computer, a satellite receiver, a cable receiver, a terrestrial broadcast receiver, a home entertainment system, and a movie theater system; and the system comprises the receiver, the upmixer, and the synthesizer.

30. A non-transitory machine-readable storage medium, having encoded thereon program code, wherein, when the program code is executed by a machine, the machine implements a method for decoding E transmitted audio channel(s) to generate C playback audio channels, where C>E≧1, the method comprising:

receiving cue codes corresponding to the E transmitted channel(s), wherein at least one cue code is an object-based cue code that directly represents a characteristic of an auditory scene corresponding to the audio channels, where the characteristic is independent of number and positions of audio sources used to create the auditory scene;

upmixing one or more of the E transmitted channel(s) to generate one or more upmixed channels; and synthesizing one or more of the C playback channels by applying the cue codes to the one or more upmixed channels, wherein the at least one object-based cue code comprises one or more of:

(1) a first measure of an absolute angle of an auditory event in the auditory scene relative to a reference direction, wherein the first measure of the absolute angle of the auditory event is estimated by:

(i) generating a vector sum of relative power vectors for the audio channels; and (ii) determining the first measure of the absolute angle of the auditory event based on the angle of the vector sum relative to the reference direction;

(2) a second measure of the absolute angle of the auditory event in the auditory scene relative to the reference direction, wherein the second measure of the absolute angle of the auditory event is estimated by:

(i) identifying the two strongest channels in the audio channels;

(ii) computing a level difference between the two strongest channels;

(iii) applying an amplitude panning law to compute a relative angle between the two strongest channels; and (iv) converting the relative angle into the second measure of the absolute angle of the auditory event;

(3) a first measure of a width of the auditory event in the auditory scene, wherein the first measure of the width of the auditory event is estimated by:

(i) estimating the absolute angle of the auditory event;

(ii) identifying two audio channels enclosing the absolute angle;

(iii) estimating coherence between the two identified channels; and (iv) calculating the first measure of the width of the auditory event based on the estimated coherence;

(4) a second measure of the width of the auditory event in the auditory scene, wherein the second measure of the width of the auditory event is estimated by:

(i) identifying the two strongest channels in the audio channels;

(ii) estimating coherence between the two strongest channels; and (iii) calculating the second measure of the width of the auditory event based on the estimated coherence;

(5) a first degree of envelopment of the auditory scene, wherein the first degree of envelopment is estimated as a weighted average of coherence estimates obtained between different audio channel pairs, where the weighting is a function of the relative powers of the different audio channel pairs;

(6) a second degree of envelopment of the auditory scene, wherein the second degree of envelopment is estimated as a ratio of (i) the sum of the powers of all but the two strongest audio channels and (ii) the sum of the powers of all of the audio channels; and (7) directionality of the auditory scene, wherein the directionality is a weighted sum of the width of the auditory event and the degree of envelopment of the auditory scene.

* * * * *